US011092348B2

(12) United States Patent
Eiermann

(10) Patent No.: US 11,092,348 B2
(45) Date of Patent: Aug. 17, 2021

(54) METHODS AND APPARATUS FOR LATENT HEAT EXTRACTION

(71) Applicant: Kenneth L. Eiermann, Winter Park, FL (US)

(72) Inventor: Kenneth L. Eiermann, Winter Park, FL (US)

(73) Assignee: Kenneth L. Eiermann, Winter Park, FL (US)

( * ) Notice: Subject to any disclaimer, the term of this patent is extended or adjusted under 35 U.S.C. 154(b) by 0 days.

(21) Appl. No.: 16/363,704

(22) Filed: Mar. 25, 2019

(65) Prior Publication Data

US 2019/0219282 A1 Jul. 18, 2019

Related U.S. Application Data

(62) Division of application No. 15/620,585, filed on Jun. 12, 2017, now Pat. No. 10,551,078.

(51) Int. Cl.

| | |
|---|---|
| ***F24F 3/153*** | (2006.01) |
| ***F24F 3/14*** | (2006.01) |
| ***F24F 11/83*** | (2018.01) |
| ***F24F 11/84*** | (2018.01) |

(52) U.S. Cl.

CPC ..... *F24F 3/153* (2013.01); *F24F 3/1405* (2013.01); *F24F 11/83* (2018.01); *F24F 11/84* (2018.01)

(58) Field of Classification Search

CPC ..... F24F 11/83; F24F 3/153
USPC ..... 62/248
See application file for complete search history.

(56) References Cited

U.S. PATENT DOCUMENTS

| | | | | |
|---|---|---|---|---|
| 1,837,798 | A | 12/1931 | Shipley | |
| 2,200,118 | A | 5/1940 | Miller | |
| 2,286,605 | A | 6/1942 | Crawford | |
| 2,291,029 | A | 7/1942 | Everetts, Jr. | |
| 2,438,120 | A | 3/1948 | Freygang | |
| 2,715,320 | A | 8/1955 | Wright | |
| 4,271,678 | A | 6/1981 | Liebert | |
| 4,658,594 | A * | 4/1987 | Langford | E04H 4/14 62/176.5 |
| 5,181,552 | A | 1/1993 | Eiermann | |

(Continued)

OTHER PUBLICATIONS

Non-Final Office Action for related U.S. Appl. No. 15/620,585, dated May 13, 2019. 13 Pages.

*Primary Examiner* — Henry T Crenshaw
(74) *Attorney, Agent, or Firm* — Tucker Ellis LLP

(57) ABSTRACT

Methods and apparatus for latent heat extraction of an air stream eliminates the need for recirculation pumps and uses the pressure in the chilled water supply to the primary chilled water cooling coil to motivate the water through the precooling and reheat coils of a run-around system. The energy transfer lowers the air temperature entering the primary coil so that the primary coil can provide a greater amount of latent heat extraction from the air stream. Both the precooling and the primary coils can share the primary cooling function for periods of peak cooling demand when precooling is not required thereby reducing the required primary cooling coil size. Enhancements combine the function of the precooling coil and the primary cooling coil into a single coil which is specially circuited for installation in the space of a standard chilled water coil eliminating the need for larger equipment rooms.

9 Claims, 14 Drawing Sheets

(56) References Cited

U.S. PATENT DOCUMENTS

| | | | | |
|---|---|---|---|---|
| 5,193,352 | A | 3/1993 | Smith et al. | |
| 5,228,302 | A | 7/1993 | Eiermann | |
| 5,309,725 | A * | 5/1994 | Cayce | F24F 3/1405 62/90 |
| 5,333,470 | A | 8/1994 | Dinh | |
| 5,337,577 | A | 8/1994 | Eiermann | |
| 5,404,938 | A * | 4/1995 | Dinh | F24F 3/1405 165/113 |
| 5,493,871 | A | 2/1996 | Eiermann | |
| 5,666,813 | A * | 9/1997 | Brune | F24F 3/153 62/510 |
| 5,802,862 | A | 9/1998 | Eiermann | |
| 2005/0235666 | A1 * | 10/2005 | Springer | F24F 3/153 62/186 |
| 2011/0289956 | A1 * | 12/2011 | Shah | F24F 3/153 62/277 |
| 2018/0356108 | A1 | 12/2018 | Eiermann | |

* cited by examiner

Psychrometric Chart – Shows a variable air volume system, full load (1) with no reheat and part load (2) with run-around reheat from example

METHODS AND APPARATUS FOR LATENT HEAT EXTRACTION

CROSS REFERENCE TO RELATED APPLICATIONS

This application is a divisional application of application Ser. No. 15/620,585 filed Jun. 12, 2017.

This application relates to U.S. Pat. No. 5,802,862 entitled: Method And Apparatus For Latent Heat Extraction With Cooling Coil Freeze Protection And Complete Recovery Of Heat Of Rejection In Dx Systems; U.S. Pat. No. 5,493,871 entitled: Method And Apparatus For Latent Heat Extraction; U.S. Pat. No. 5,337,577 entitled: Method And Apparatus For Latent Heat Extraction; U.S. Pat. No. 5,228,302 entitled: Method And Apparatus For Latent Heat Extraction; and U.S. Pat. No. 5,181,552 entitled: Method And Apparatus For Latent Heat Extraction, the contents of each of which are fully incorporated herein by reference.

TECHNICAL FIELD

The example embodiments relate to the air conditioning arts including heating, cooling, dehumidification, air quality conditioning, and the like and, more particularly they relate to methods and apparatus for improved latent heat extraction of an air stream that use existing pressure in an otherwise standard chilled water supply (two-pipe systems) or in otherwise standard chilled and hot water supplies (four-pipe systems) for motivating the water working fluid through one or more of a precooling coil and/or a reheat coil of a run-around coil system.

OVERVIEW OF THE EXAMPLE EMBODIMENTS

This application pertains to the art of air conditioning methods and apparatus. More particularly, this application pertains to methods and apparatus for efficient control of the moisture content of an air stream which has undergone a cooling process as by flowing through a cooling coil or the like. The example embodiments shown and described herein are specifically applicable to heating, cooling, and dehumidification of a supply air flow to be delivered into the occupied space of commercial or residential structures. The return air flow entering the air conditioning coil is precooled with a precooling coil in operative fluid communication with the primary chilled water cooling coil. The air flow leaving the precooling coil is cooled with a primary cooling coil in operative fluid communication with the supply chilled water flow from a chilled water cooling plant. By means extracted return air flow heat energy the supply air may be selectively warmed using a reheat coil apparatus. Heating of the occupied space may be effected using the combined reheat and cooling coils in conjunction with an alternative heat source such as gas, oil, solar, electric, or the like and will be described with particular reference thereto.

The example embodiments herein are operable with associated two-pipe and/or four-pipe air conditioning systems. The example embodiments herein eliminate the need for the separate specialized fluid pump described above by instead using the pressure already existing in the working fluid(s) of the two- and/or four-pipe systems, typically water, supplied to the chilled water coil and/or to the reheat coil for the pressure required to circulate the water in the run-around system.

In addition to eliminating the need for the separate fluid pump, another benefit of the example embodiments is that both the precooling and the primary coils can share the primary cooling function for periods of peak cooling demand when precooling is not required. This shared cooling ability will enables a reduction in the size of the primary cooling coil.

Another enhancement of this method combines the function of the precooling coil and the primary cooling coil into a single coil which is specially circuited. The specially circuited single coil can then be installed in the space of a standard chilled water coil and eliminated the need for larger equipment rooms.

It will be appreciated, though, that the embodiments have other and broader applications such as cyclic heating applications wherein a supply air flow is heated at the reheat coil and/or the precooling coil when used for heating application, irrespective of the instantaneous operation mode of chilled water plant cooling.

BACKGROUND

Conventional chilled water air conditioning systems use chilled water as a working medium to cool an air stream through the action of heat transfer as the air stream comes in close contact with the chilled water in a finned tube heat exchanger commonly referred to as a chilled water cooling coil and herein called the primary cooling coil. Cooling is accomplished by a reduction of temperature in the air stream as the air stream comes in close contact with the fins of the primary cooling coil. The chilled water passes through the tubes of the coil and extracts heat from the air stream. This reduction of temperature is commonly called sensible cooling. A corresponding simultaneous reduction in the moisture content of the air steam typically also occurs to some extent and is known as latent cooling or more generally dehumidification or moisture removal. Usually cooling itself is controlled by means of a thermostat or other type apparatus in the occupied space or in the return air stream which corresponds to changes in the dry bulb air temperature. When controlled in this manner, dehumidification of the indoor air occurs only when there is a demand for reduced temperature as dictated by the thermostat.

Existing standard run-around coil systems typically use a specialized fluid pump to exchange energy between the return and supply air flows of a primary chilled water cooling coil. The energy transfer lowers the air temperature entering the primary coil so that the primary coil can provide a greater amount of latent heat extraction from the air stream. While schemes such as these have been found to be somewhat effective, the specialized fluid pump adds costs and complexity to the system. Also, the specialized fluid pump requires maintenance and can be a source of system failure.

A standard two-pipe air conditioning system 100 is shown in FIG. 1. The two-pipe chilled water air conditioning system 100 shown there includes a housing 110 configured to receive a warm return air flow 120 into the housing and to exhaust the warm return air flow from the housing as a cooled supply air flow 130. The cooled supply air flow might be delivered to an occupied space in a house or commercial building, for example. A cooling coil 140 is disposed in the housing and is configured to permit a working fluid 150 to flow therethrough. The working fluid passing through the cooling coil 140 absorbs thermal energy from the warm return air flow 120 passing through fins or other structures of the cooling coil 140 thereby rendering the cooled supply air flow 130 exiting from the housing 110.

The cooling coil 140 is mechanically and thermally coupled with a plurality of cooling fins (not shown), and is in operative fluid communication with a chilled water source conduit 162 and with a chilled water return conduit 166. The cooling coil 140 receives at an input 142 thereof the working fluid 150 from an associated chilled water source 160 via the chilled water source conduit 162. For completing the fluid circuit, the cooling coil 140 expels at an output 144 thereof the working fluid 150 to an associated chilled water return 164 via the chilled water return conduit 166.

Overall then, the standard two-pipe air conditioning system 100 includes a cooling coil 140 where a working fluid 150 flowing through the cooling coil 140 absorbs thermal energy from a return air flow 120 as a cooled supply air flow 130. A chilled water source conduit 162 delivers the working fluid 150 from an associated chilled water source 160 to the cooling coil 140, and a chilled water return conduit 166 returns the working fluid 150 from the cooling coil 140 to an associated chilled water return 164.

A standard four-pipe air conditioning system 200 is shown in FIG. 2. The four-pipe chilled water air conditioning system 200 shown there includes a housing 210 configured to receive a warm return air flow 220 into the housing 210 and to exhaust the warm return air flow 220 from the housing 210 as a cooled supply air flow 230. The cooled supply air flow 230 might be delivered to an occupied space in a house or commercial building, for example. A cooling coil 240 is disposed in the housing 210 and is configured to permit a cold working fluid 250 to flow therethrough. The cold working fluid 250 passing through the cooling coil 240 absorbs thermal energy from the warm return air flow 220 passing through fins or other structures of the cooling coil 240 thereby rendering the cooled supply air flow 230 exiting from the housing 210.

The cooling coil 240 is mechanically and thermally coupled with a plurality of cooling fins (not shown), and is in operative fluid communication with a chilled water source conduit 262 and with a chilled water return conduit 266. The cooling coil 240 receives at an input 242 thereof the cold working fluid 250 from an associated chilled water source 260 via the chilled water source conduit 262. For completing the cooling fluid circuit, the cooling coil 240 expels at an output 244 thereof the cold working fluid 250 to an associated chilled water return 264 via the chilled water return conduit 266.

To accomplish dehumidification when the thermostat does not indicate a need for cooling, a humidistat or humidity sensor in combination with a controller is often added to control the chilled water flow in order to remove moisture from the cooled air stream as a "byproduct" function of the cooling. In this mode of operation, heat must be selectively added to the cooled air stream to prevent the occupied space from over-cooling below the dry bulb set point temperature or the thermostat. The adding of heat to the cooled air stream is commonly referred to as reheat.

Many sources of heat have been used for reheat purposes, such as hydronic hot water with various fuel sources, hydronic heat recovery sources, gas heat, hot refrigerant gas heat, hot liquid refrigerant heat and electric heat. Electric heat is commonly used because it is typically the least expensive to install. However, the use of electric heat typically is the most expensive to operate and in some instances is precluded from use by local law.

The standard four-pipe air conditioning system 200 as shown in FIG. 2 includes reheat coil 270 disposed in the housing 210 for providing heat to accomplish the reheat function when the system is in the dehumidification mode and when the thermostat does not indicate a need for cooling as described above. The reheat coil 270 is configured to permit a warm working fluid 252 to flow therethrough. As illustrated, the supply air flow 230 includes an upstream supply air flow 232 entering into the reheat coil 270, and a downstream supply air flow 234 exiting from the reheat coil 270. The warm working fluid 252 passing through the reheat coil 270 adds thermal energy into the upstream supply air flow 232 entering into the reheat coil 270 and passing through fins or other structures of the reheat coil 270, thereby providing a warmer reheated downstream supply air flow 234 exiting from the reheat coil 270 and delivered into the working space, for example.

The reheat coil 270 is mechanically and thermally coupled with a plurality of cooling fins (not shown), and is in operative fluid communication with a warm water source conduit 282 and with a warm water return conduit 286. The reheat coil 270 receives at an input 272 thereof the warm working fluid 252 from an associated warm water source 280 via the warm water source conduit 282. For completing the reheating fluid circuit, the reheat coil 270 expels at an output 274 thereof the warm working fluid 252 to an associated warm water return 284 via the warm water return conduit 286.

Overall then, the standard four-pipe air conditioning system 200 includes a cooling coil 240 where a cold working fluid 250 flowing through the cooling coil 240 absorbs thermal energy from a return air flow 220 as a cooled supply air flow 230, and a reheat coil 270 where a warm working fluid 252 flowing through the reheat coil 270 adds thermal energy into the cooled supply air flow 230 as a reheated supply air flow 234. A chilled water source conduit 262 delivers the cold working fluid 250 from an associated chilled water source 260 to the cooling coil 240, and a chilled water return conduit 266 returns the cold working fluid 250 from the cooling coil 240 to an associated chilled water return 264. Similarly, a warm water source conduit 282 delivers the warm working fluid 252 from an associated warm water source 280 to the reheat coil 270, and a warm water return conduit 286 returns the warm working fluid 252 from the reheat coil 270 to an associated warm water return 284.

In order to conserve energy, it has been suggested that recovered heat may be used as a source for the reheat. Accordingly, one method to improve the moisture removal capacity of the primary chilled water coil, while simultaneously providing reheat, is to provide two coils, each in one of the air streams entering or leaving the primary chilled water coil, while circulating a working fluid, often water, between the two coils. This arrangement is commonly call a run-around loop.

The success of these run-around systems is undeniable. The run-around system working fluid is cooled in the first coil, called the reheat coil, which is placed in the supply air stream of the primary coil. The cooled working fluid is then in turn caused to circulate through a second coil, called a precooling coil, placed in the return air stream of the primary coil. The circulation of the run-around system working fluid is provided by a fluid pump which is located in the pipeline connecting the two coils. This simple closed loop circuit comprises the typical run-around systems available heretofore.

FIG. 3 is a schematic view of a unique air conditioning system 300 that has been proposed for use with the single chilled water supply 160 and chilled water return 164 of the standard two-pipe air conditioning system 100 of FIG. 1. The air conditioning system 300 includes a cooling coil 340 where a cold working fluid 350 flowing through the cooling coil 340 absorbs thermal energy from a return air flow 320 as a cooled supply air flow 330, and a reheat coil 370 where a portion of the cold working fluid 350 may circulate. The cooling coil 340 is divided into a primary cooling portion 340' and a precooling portion 340". The cold working fluid 350 enters into the primary cooling coil 340' at an input port 342 of the cooling coil 340 and exits the cooling coil 340 at two (2) exit ports including a first exit port 344' in fluid communication with the primary cooling coil 340' portion of the cooling coil 340, and a second exit port 344" in fluid communication with the precooling coil portion 340" of the cooling coil 340. The portion of the cold working fluid exiting the cooling coil 340 from the first port 344' is returned to the chilled water return 364 via a chilled water return conduit 366. The portion of the cold working fluid exiting the cooling coil 340 from the second port 344" is delivered in part to an input 372 of the reheat coil 370 and in part to a control valve system 390. In the air conditioning system 300 illustrated, the control valve system controls the proportion of chilled working fluid exiting the precooling coil portion 340" of the cooling coil 340 that is delivered to the reheat coil 370 versus the amount that is returned to the chilled water return 364 thereby effecting control over the reheat circuit.

In general in the subject relevant art, the cooling capacity required of the primary coil is equal to the total cooling required to cool and dehumidify the conditioned space less the amount of cooling provided by the precooling coil. Since the precooling is a function of the amount of reheat used, if there is no demand for reheat, as in a peak sensible cooling demand in the space, then there would be no precooling available to offset the primary cooling capacity required. Therefore, the capacity of the primary coil is based on the total peak cooling load. The capacity of the precooling coil is a function of the amount of heat required for the heat required by the reheat coil.

The heat exchange surface of the precooling and primary cooling coils is selected for their respective peak duties which generally is; peak sensible room cooling for the primary coil and, peak dehumidification for the precooling coil. As such, since these two duties are not simultaneous, the total surface area of the two coils is greater than an optimized coil selected for each of the individual duties.

It has, therefore, been deemed desirable to provide a system that would allow the two coils to share the respective precooling and primary cooling needed to satisfy the various operating conditions representing cooling requirements from peak sensible cooling to dehumidification and that said system will be made compact to conserve space and said system will eliminate the pump of the closed loop run-around system.

It has also been deemed desirable to provide systems and methods that improve on efficiencies and capabilities of the prior systems shown in FIGS. 1-3.

SUMMARY OF THE EMBODIMENTS

The embodiments herein improve the cooling and dehumidification of a conventional chilled water air conditioning system through the addition of a run-around system that integrates the primary chilled water coil with the run-around system precooling coil and reheat coils such that the cooling duty of both the primary coil and the precooling coil operate together and sequentially on the same flow of chilled water. The chilled water flow leaving the precooling coil which has been warmed by the heat extracted in both the primary coil and the precooling coils can be diverted to the reheat coil as needed for reheat duty to accomplish humidity control. A system so configured is capable of operating continuously over a wide range of conditions for providing indoor space dehumidification independent of the sensible cooling requirement of the space cooling. Further, the overall system may be used to heat the space through the expedient use of a heating hot water source according to the preferred embodiments.

In one embodiment, the two cooling coils are arranged in series air flow and series counter chilled water flow for cooling and dehumidification duty and a heating coil is provided downstream of the primary cooling coil for reheat duty. Control valves are used to divert the water flow through the various flow circuits of the invention. In another embodiment the functions of both the precooling coil and the primary cooling coil are combined in a single coil specially circuited to integrate both the precooling and primary cooling functions.

Additional advantages and features of the embodiments herein will become apparent from the following description and appended claims, taken in conjunction with the accompanying drawings.

BRIEF DESCRIPTION OF THE DRAWINGS

The embodiments herein may take physical form in certain parts and arrangements of parts which will be described in detail in this specification and illustrated in the accompanying drawings which form a part hereof and wherein.

DETAILED DESCRIPTION OF EXAMPLE EMBODIMENTS

Figure 1:
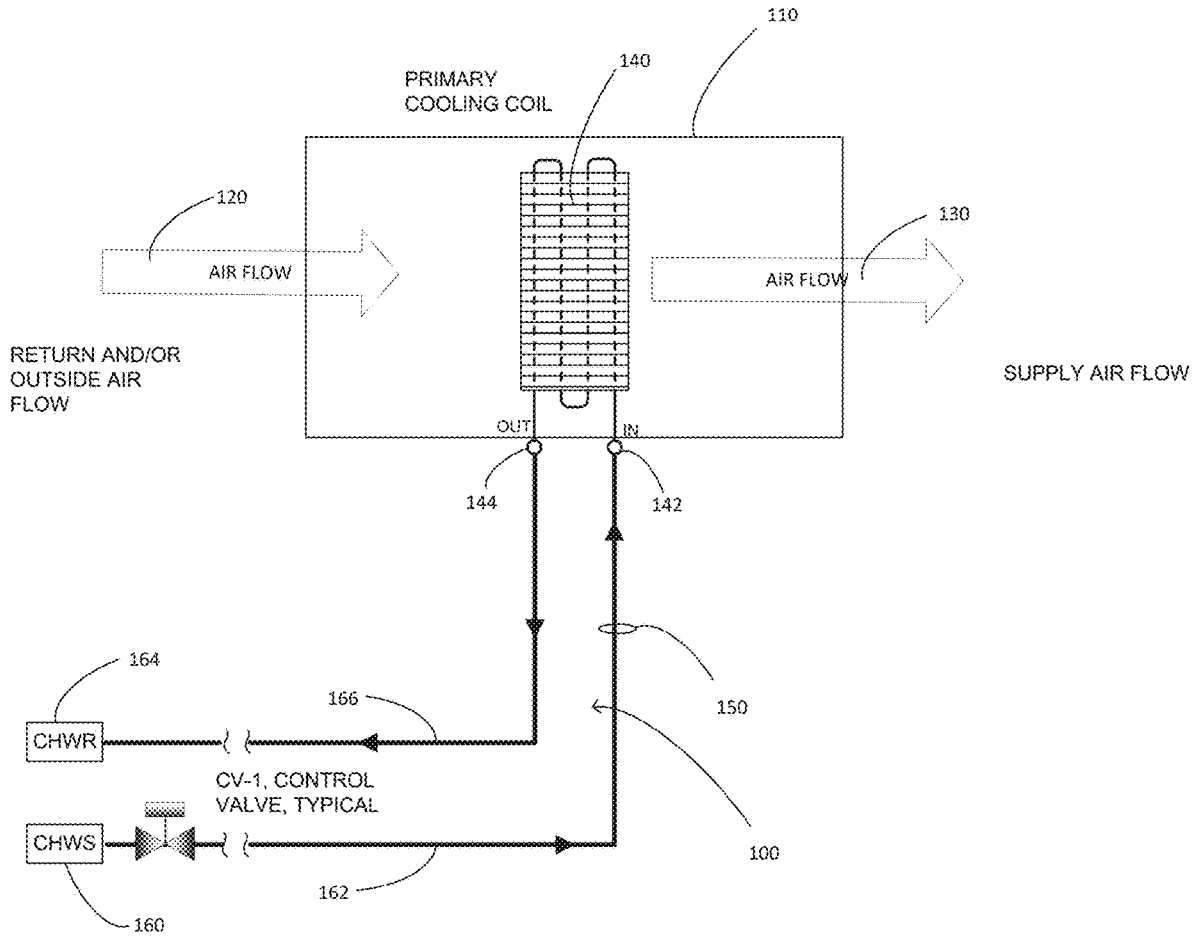
FIGURE 1 Prior Art
FIG. 1 is a schematic view of a standard two-pipe air conditioning system as known in the art.

Referring now to the drawings wherein showings are for the purposes of illustrating the preferred embodiments of the invention only and for purposes of limiting same, the FIGURES show a moisture control apparatus 10 for conditioning the air in an occupied space.

Figure 4:
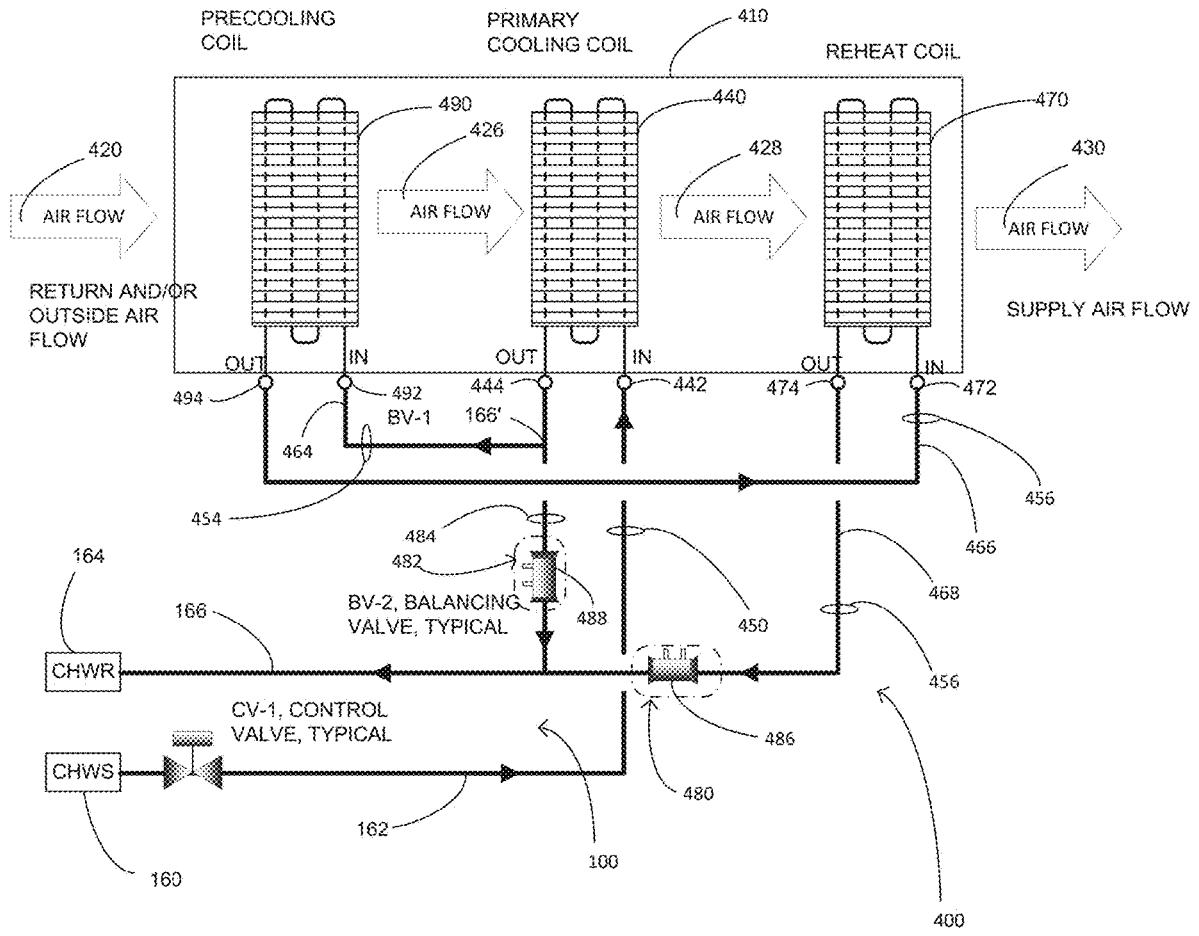
FIG. 4 illustrates a schematic view of a moisture control system operable with the single chilled water supply 160 and chilled water return 164 of the standard two-pipe air conditioning system 100 of FIG. 1 for latent heat extraction in accordance with a first embodiment.

FIG. 4 illustrates a schematic view of a moisture control system operable with a single chilled water supply 160 and a chilled water return 164 of a standard two-pipe air conditioning system 100 (FIG. 1) for latent heat extraction in accordance with a first embodiment. With reference first to FIG. 4, an air conditioning system 10 providing improved latent heat extraction of an air stream 20 in accordance with an example embodiment is illustrated. The system 10 comprises, in general, a coil set 30 and a conduit system 40 configured to deliver a chilled water supply (CHWS) to the coil set 30 from an associated chilled water source (not shown), selectively circulate the chilled water between various components of the coil set 30 as will be described in detail below, and to return the circulating water as a chilled water return (CHWR) to the associated chilled water source (not shown). Overall, the system 10 manages precise control over latent heat extracted from a return and/or outside air stream 22 of the air stream 20 for delivery of a supply air flow 24 to an occupied space such as a building or the like.

In the example embodiment, the coil set 30 comprises three (3) coils arranged in series relative to the air stream 20. In particular, the coil set 30 comprises a precooling coil 32, a primary cooling coil 34, and a reheat coil 36. In the example embodiment of FIG. 4, each of the precooling coil 32, the primary cooling coil 34, and the reheat coil 36 are separately formed. The precooling coil 32, the primary cooling coil 34, and the reheat coil 36 collectively transform the return air stream 22 of the air stream 20 into the supply air flow 24 with improved latent heat properties by first converting the return air flow 22 into a precooled air flow 26 using the precooling coil 32, then converting the precooled air flow 26 to a cooled air flow 28 using the primary cooling coil 34, and lastly by converting the cooled air flow 28 to the air flow 24 for delivery to the occupied space.

The working fluid hereinafter called chilled water enters the piping of the system at CHWS and continues to the Primary Cooling Coil inlet a where the chilled water enters the tubes of the coil and exits the coil at the coil outlet b. As the chilled water passes through the tubes of the Primary Cooling Coil 34 the water is warmed by the air which passes over the fins of the coil. The chilled water leaving the chilled water coil will either flow to the inlet d of the Precooling Coil 32 or be extracted c from the system in a proportion of the total chilled water flow by the action of the preset balancing valves, BV-1 and BV-2. The portion of chilled water that flows to point d is used for reheat. The chilled water enters the precooling coil 32 at point d and leaves the precooling coil at point e. The chilled water passing through the coil is warmed by the heat transfer though the fins and tubes of the coils as the air flow 22 is cooled to condition at 26. Because the chilled water flow through the precooling coil is a portion of the total chilled water flow at point b the water flow will increase in temperature at a greater rate than had the full chilled water flow been transferred through the precooling coil. The greater temperature of the chilled water flow is beneficial for the reheat function of the reheat coil 36.

The chilled water flow warmed by the precooling function is transferred from the outlet of the precooling coil e by a pipe that connects the to the inlet of the reheat coil f. The warmed chilled water flows through the tubes of the reheat coil. The water cools as heat is transfer though the tubes and the fins of the coil 36 as the air flow is warmed as it flows from 28 to 24. The warmed chilled water flow that is re-cooled by the heat transfer action of the reheat process is transfer through a pipe to point h where it is recombined with the chilled water flow from point c. The recombined total flow is transferred through a pipe to the chilled water return pipe CHWR where it will return to the central chilled water plant, not shown.

FIG. 4 illustrates a schematic view of a moisture control system operable with the single chilled water supply 160 and chilled water return 164 of the standard two-pipe air conditioning system 100 of FIG. 1 for latent heat extraction in accordance with a first embodiment.

The embodiment of FIG. 4 is particularly well-suited and finds particular use in applications where it is desirable to provide a warm and dehumidified supply air flow 930.

The embodiment is beneficial because it uses recovered heat from the precooling process of the precooling coil 490 to provide heat for the reheat process in the reheat coil 470.

It has advantages over the earlier systems such as those shown in FIG. 1 including means of providing reheat.

Figure 2:
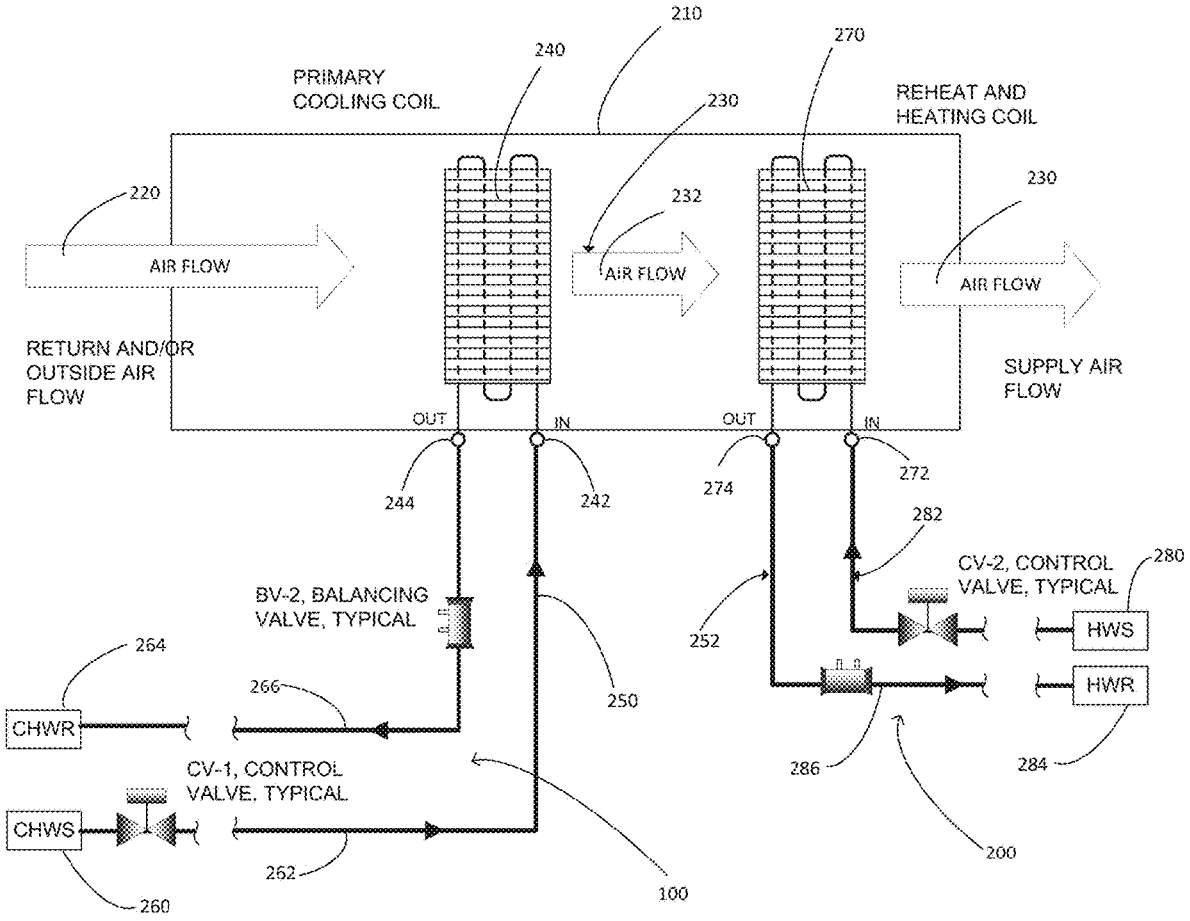
FIGURE 2 Prior Art
FIG. 2 is a schematic view of a standard four-pipe air conditioning system as known in the art.
Figure 3:
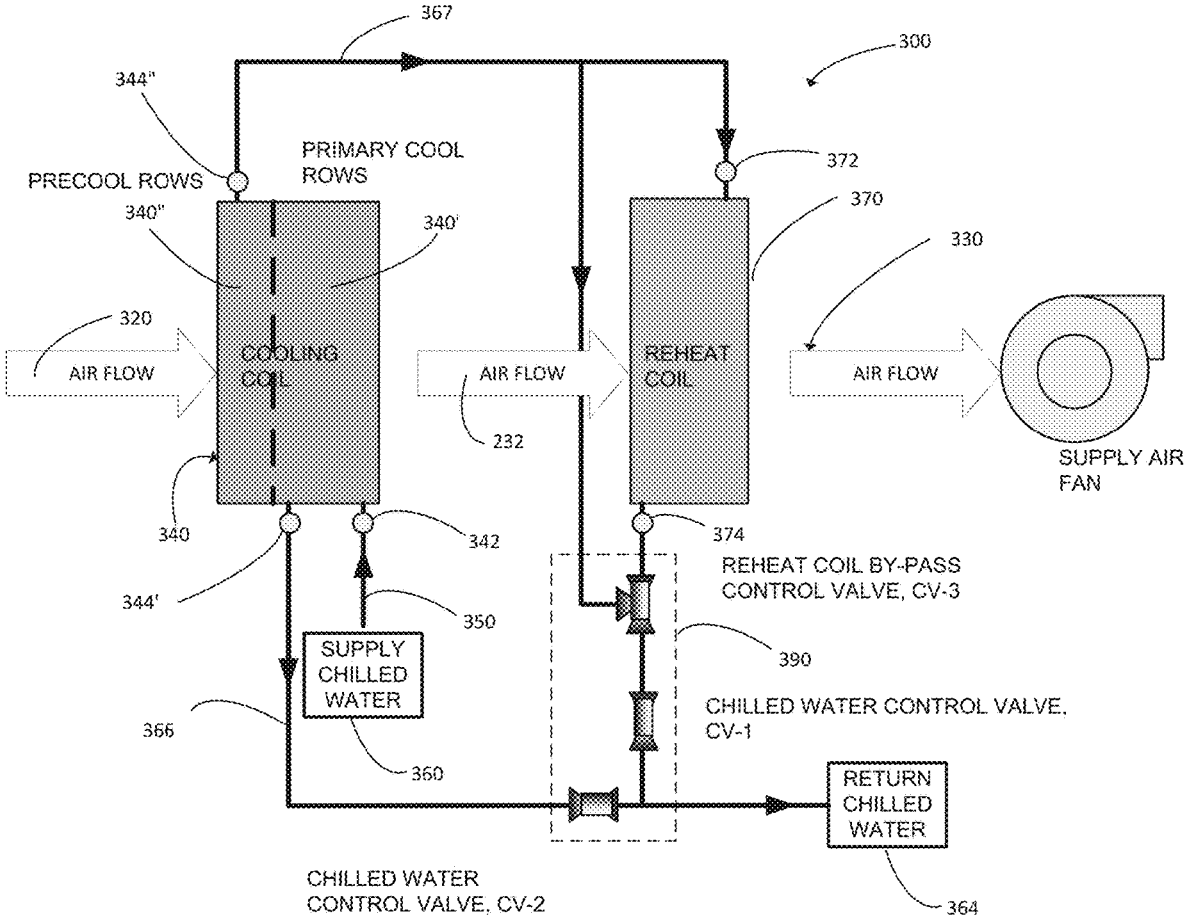
FIGURE 3 Prior Art
FIG. 3 is a schematic view of an air conditioning system with reheat as known in the art and usable with the single chilled water supply of the standard two-pipe air conditioning system of FIG. 1.

It has further advantages over the earlier systems such as those shown in FIG. 2 including using recovered heat for reheat and a reduction of the return working fluid 456 temperature thereby reducing the return working fluid 164 temperature to reduce the cooling requirement of the central chilled water system.

FIG. 4 shows a moisture control system 400 in accordance with an example embodiment for use with an associated two-pipe chilled water air conditioning system 100 including an associated cooling coil 440 where a working fluid 450 flowing through the cooling coil 440 absorbs thermal energy from a return air flow 420 as a cooled supply air flow 430, an associated chilled water source conduit 162 delivering the working fluid 450 from an associated chilled water source 160 to the cooling coil 440, and an associated chilled water return conduit 166 returning the working fluid 450 from the cooling coil 440 to an associated chilled water return 164. In the illustration of the example embodiment shown, the moisture control apparatus 400 includes a precooling coil 490 in the return air flow 420, a reheat coil 470 in the supply air flow 430, a wrap-around fluid conduit 464, 466, and a regulator circuit 480. The precooling coil 490 receives a first portion 454 of the working fluid 450 and exchanges thermal energy between the return air flow 420 and the first portion 454 of the working fluid 450 flowing through the precooling coil 490. The reheat coil 470 receives a second portion 456 of the working fluid 450 and exchanges thermal energy between the second portion 456 of the working fluid 450 flowing through the reheat coil 470 and the supply air flow 430. The wrap-around fluid conduit 464, 466 is in operative fluid communication with the associated chilled water return conduit 166, the precooling coil 490, and the reheat coil 470. The wrap-around fluid conduit 464, 466 containedly directs the first and second portions 454, 456 of the working fluid 450 through a series arrangement of an input 166' of the wrap-around fluid conduit 464, 466, the precooling coil 490, the reheat coil 470, and the associated chilled water return conduit 166. The regulator circuit 480 is operatively coupled with the input 166' of the wrap-around fluid conduit 464, 466 and with the associated chilled water return conduit 166. The regulator circuit 480 meters the first portion 454 of the working fluid 450 from the associated chilled water return conduit 166 for communication of the first portion 454 of the working fluid 450 to the input 166' of the wrap-around fluid conduit 464, 466.

It is to be appreciated that in the example embodiment, the precooling coil 490 of the example moisture control system 400 includes an input 492 in operative fluid communication with the associated chilled water return conduit 166, and the reheat coil 470 similarly includes an output 474 in operative fluid communication with the associated chilled water return conduit 166. Preferably, the wrap-around fluid conduit 466 containedly directs all of the first portion 456 of the working fluid 450 from an output 494 of the precooling coil 490 to an input 472 of the reheat coil 470 as the second portion 456 of the working fluid 450. The wrap-around fluid conduit 468 further preferably containedly directs all of the second portion 456 of the working fluid 450 from the output 474 of the reheat coil 470 to the associated chilled water return conduit 166 for return of the second portion 456 of the working fluid 450 to the associated chilled water return 164.

In an embodiment, the regulator circuit 480 of the moisture control system 400 includes a balancing valve system 488. Preferably the balancing valve system 488 is disposed at a fluid connection between a first connection 166" to the associated chilled water return conduit 166 and the input 166' of the wrap-around fluid conduit 464, 466. In that way the balancing valve 488 can be set to establish the first flow 454 of the working fluid 450 using the pressure of the working fluid to effect the flow of the first portion into the wrap-around conduit 464 at the inlet 166' to the wrap-around conduit 464.

In a particular example embodiment, the balancing valve system 486 of the regulator circuit 480 of the subject example moisture control system 400 includes first and second manual balancing valves 486, 488. The first manual balancing valve 486 is disposed between a first connection 166" to the associated chilled water return conduit 166 and the input 166' of the wrap-around fluid conduit 464, 466. In its preferred form, the first manual balancing valve 488 is adjustable to control a flow volume of the working fluid 450 entering the input 166' of the wrap-around fluid conduit 464, 466 as the first portion of the working fluid 450. Also in its preferred form, the second manual balancing valve 486 is disposed in-line in the associated chilled water return conduit 166 between the first connection 166" to the associated chilled water return conduit 166 and the associated reheat coil 470 outlet connection 474. The first manual balancing valve 488 is adjustable to control a pressure of the working fluid 450 at the first connection 166'.

Operationally, the regulator circuit 480 of the subject example moisture control system 400 meters the first portion 454 of the working fluid 450 from the associated chilled water return conduit 166 for communication of the first portion 454 of the working fluid 450 to the input 492 of the precooling coil 490.

The moisture control system 400 according to a further example embodiment includes the components described above in combination with the cooling coil 440, the chilled water source conduit 162 delivering the working fluid 450 from the associated chilled water source 160 to the cooling coil 440, and the chilled water return conduit 166 returning the working fluid 450 from the cooling coil 440 to the associated chilled water return.

Figure 5:
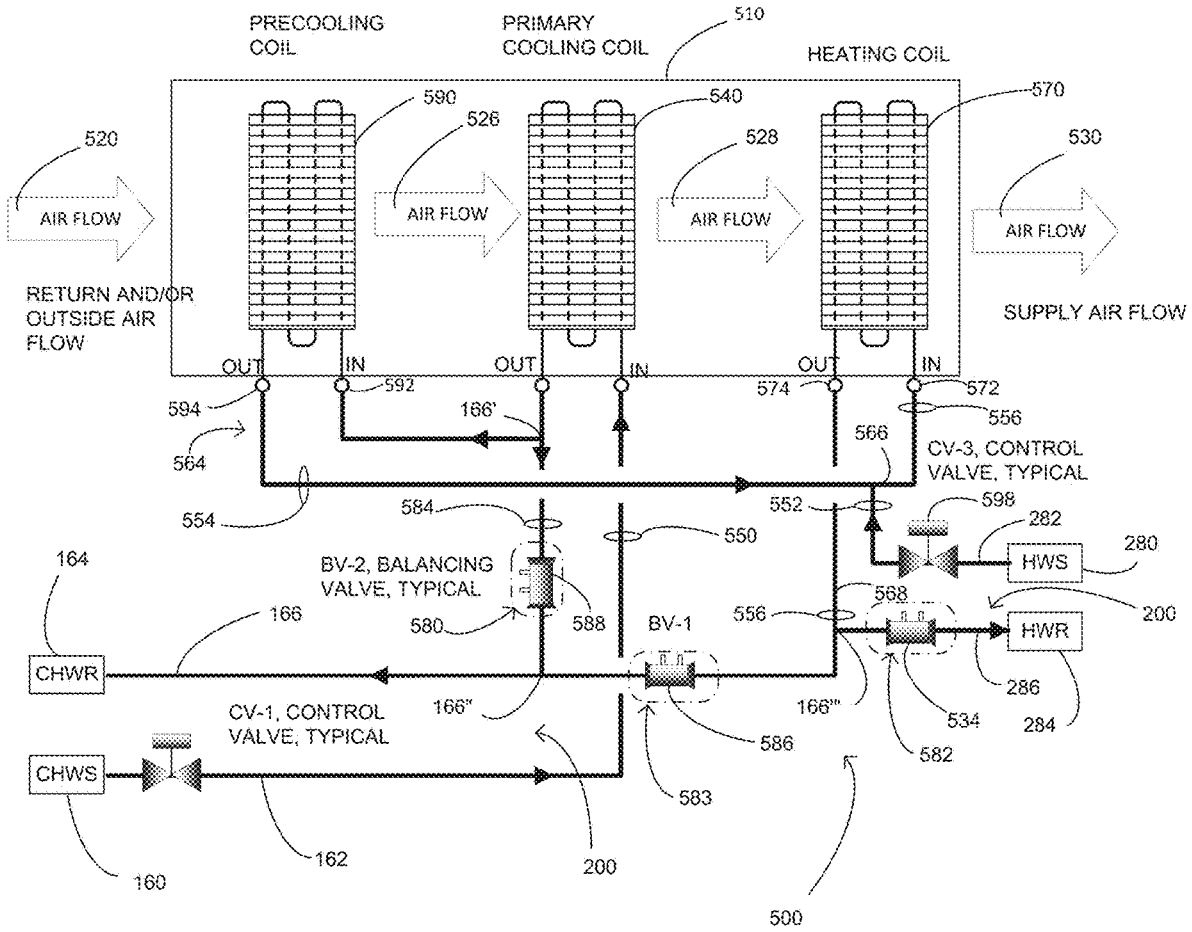
FIG. 5 illustrates a schematic view of a moisture control system operable with the chilled water supply 160 and return 164 and the warm water supply 280 and return 284 of the standard four-pipe air conditioning system 200 of FIG. 2 for latent heat extraction in accordance with a second embodiment.

FIG. 5 illustrates a schematic view of a moisture control system operable with the chilled water supply 160 and return 164 and the warm water supply 280 and return 284 of the standard four-pipe air conditioning system 200 of FIG. 2 for latent heat extraction in accordance with a second embodiment. Referring to FIG. 5 a heat source is added to the piping system. The heat source is a hot water supply, HWS, from a central heating plant, not shown, or a local water heater, also not shown. The hot water supply is controlled by control valve CV-3 598. Hot water flow is introduced to the system in the pipe at the inlet to the reheat/heating coil at 572. The working fluid flow through the reheat coil 570 will be a mixture of the first working fluid flow and the hot water flow 552. This will provide an increase of the working fluid flow 556 in proportion to the flow at 552. The increased temperature and the increased flow will provide an increase in heat transferred to the air stream as previously described. This heat will supplement the heat provided in the precooling process when needed to satisfy the heat required in the reheat process. The heat source hot water return 284 (HWR) returns in proportion to the HWS to the hot water system, not shown through a pipe connected to the piping 564 at point 572. The HWS can also be used for heating purposes when there is no demand for cooling or dehumidification in the conditioned room or process. The chilled water valve CV-1 is closed preventing water from transferring to the chilled water system. The heating hot water valve CV-3 598 opens to allow hot water to enter heating coil at heating coil inlet 572 and leave at outlet 574 after transferring heat to the air flow (528 to 530) as previously described. The hot water return (HWR) from 574 returns to the heating hot water system 284, not shown.

The embodiment of FIG. 5 is particularly well-suited and finds particular use in applications where a variable temperature of the supply air flow is desired above which can be provided by the heat from the precooling process.

The embodiment is beneficial because heat available from a heat source 280 can be added to the heat from the precooling process to provide an increase in the temperature of the supply air flow.

It has advantages over the earlier systems such as those shown in FIG. 1 including a hot water source for a reheat process to raise the temperature and lower the relative humidity of the supply air flow 530.

It has further advantages over the earlier systems such as those shown in FIG. 2 including the use of the heat transferred from the air in the precooling process which becomes the first heat for the reheat process in the reheat coil and which said heat transfer in the precooling process causes a reduction of heat in the chilled water working fluid thereby reducing the requirement of cooling in the chilled water central plant (not shown).

FIG. 5 shows a moisture control system 500 in accordance with an example embodiment for use with an associated four-pipe chilled water air conditioning system 200 (FIG. 2) including an associated cooling coil 540 where a cold working fluid 550 flowing through the associated cooling coil 540 absorbs thermal energy from a return air flow 526 as a cooled supply air flow 528, an associated reheat coil 570 where a warm working fluid 552 flowing through the reheat coil 570 adds thermal energy to the cooled supply air flow 528 as a reheated supply air flow 530, an associated chilled water source conduit 162 delivering the cold working fluid 550 from an associated chilled water source 160 to the cooling coil 54Q an associated chilled water return conduit 166 returning the cold working fluid 550 from the cooling coil 540 to an associated chilled water return 164, an associated hot water source conduit 282 delivering the warm working fluid 552 from an associated hot water source 280 to the reheat coil 570, an associated hot water return conduit 286 returning the warm working fluid 552 from the reheat coil 570 to an associated hot water return 284. In the illustration of the example embodiment shown, the moisture control apparatus 500 includes a precooling coil 590 in the return air flow 520, a wrap-around fluid conduit 564, and a flow regulator system 580, 582, 583, 598. The precooling coil 590 receives a first portion 554 of the cold working fluid 550 and exchanges thermal energy between the return air flow 520 and the first portion 554 of the cold working fluid 550 flowing through the precooling coil 590.

The wrap-around fluid conduit 564 of the example embodiment is in operative fluid communication with the associated chilled water return conduit 166, the precooling coil 590, the associated reheat coil 570, and the hot water return conduit 286. The wrap-around fluid conduit 564 containedly directs the first portion 554 of the cold working fluid 550 through a series arrangement of an input 166' of the wrap-around fluid conduit 564, the precooling coil 590, and the associated reheat coil 570.

The flow regulator system 580, 582, 583, 598 of the example embodiment is operatively coupled with the input 166' of the wrap-around fluid conduit 564 and with the associated chilled water return conduit 166. Functionally, a portion of the flow regulator system 580, 582, 583, 598 meters the first portion 554 of the cold working fluid 550 from the associated chilled water return conduit 166 for communication of the first portion 554 of the cold working fluid 550 to the input 166' of the wrap-around fluid conduit 564.

In particular and as shown, in the subject example embodiment, the precooling coil 590 of the moisture control system 500 includes an input 592 in operative fluid communication with the associated chilled water return conduit 166 via the wrap-around fluid conduit 564. Further, the wrap-around fluid conduit 564 is configured to containedly direct all of the first portion 556 of the cold working fluid 550 from an output 594 of the precooling coil 590 to an input 572 of the associated reheat coil 570. Yet still further, the wrap-around fluid conduit 564 of the example embodiment includes a bridge conduit portion 566 fluidically coupling the associated chilled water return conduit 166 with the associated hot water source conduit 282.

In its preferred form, the flow regulator system 588, 582, 583, 598 of the moisture control system 500 according to the example embodiment illustrated includes a first flow regulator 580 comprising a first balancing valve 588, a second flow regulator 583 comprising a second balancing valve 586, and a third flow regulator 582 comprising a third balancing valve 534. Preferably, the balancing valves are disposed at fluid connections between: the input 166' of the wrap-around fluid conduit 564, a first connection 166" to the associated chilled water return conduit 166; an output 574 of the reheat coil 570; and the associated hot water return conduit 286.

In one form of the example embodiment, the flow regulator system 580, 582, 583, 598 of the moisture control system 500 includes a first balancing valve 588, and second and third balancing valves 586, 534. As shown, the first balancing valve 588 is disposed in-line between the input 166' of the wrap-around fluid conduit 564 and the first connection 166" to the associated chilled water return conduit 166. Further as shown, the second and third balancing valves are disposed at the connections between the associated hot water return conduit 286, the output 574 of the reheat coil 570, and the first connection 166" to the associated chilled water return conduit 166.

It is preferred that the first balancing valve 588 of the moisture control system 500 according to the example embodiment is adjustable to control a flow volume of the cold working fluid 550 entering the input 166' of the wrap-around fluid conduit 564 as the first portion 554 of the cold working fluid 550. In that way the balancing valve 588 can be set to establish the first flow 554 of the working fluid 550 using the pressure of the working fluid to effect the flow of the first portion into the wrap-around conduit 564 at the inlet 166' to the wrap-around conduit 564.

Yet still further as shown, the third balancing valve 534 of the third flow regulator 582 is disposed between the associated hot water return conduit 286 and a second connection 166'" to the associated chilled water return conduit 166. The third balancing valve 534 is adjustable to control a flow volume of a blend of the warm and cold working fluids being returned to the associated hot water return 284. Similarly, the second balancing valve 586 of the second flow regulator 583 is disposed between the first and second connections 166", 166'" to the associated chilled water return conduit 166, the second balancing valve 586 being adjustable to control a flow volume of the blend of the warm and cold working fluids being returned to the associated cold water return 264.

The various components of the example embodiment are preferably plumbed as shown. More particularly, the output 574 of the reheat coil 570 is in fluid communication with the associated hot water return conduit 286 via the third balancing valve 534. Somewhat similarly, the output 574 of the reheat coil 570 is in fluid communication with the associated chilled water return 164 via the second balancing valve 586.

An automatic throttling valve 598 is further provided in the flow regulator system 580, 582, 583, 598 of the moisture control system 500 according to the embodiment illustrated. As shown, the automatic throttling valve 598 is disposed between the associated hot water source conduit 282 and the wrap-around fluid conduit 564. Functionally, the automatic throttling valve 598 is responsive to a control signal from an associated control device to throttle a flow of the warm working fluid 552 entering into the associated reheat coil 570 via the wrap-around fluid conduit 564.

Figure 6:
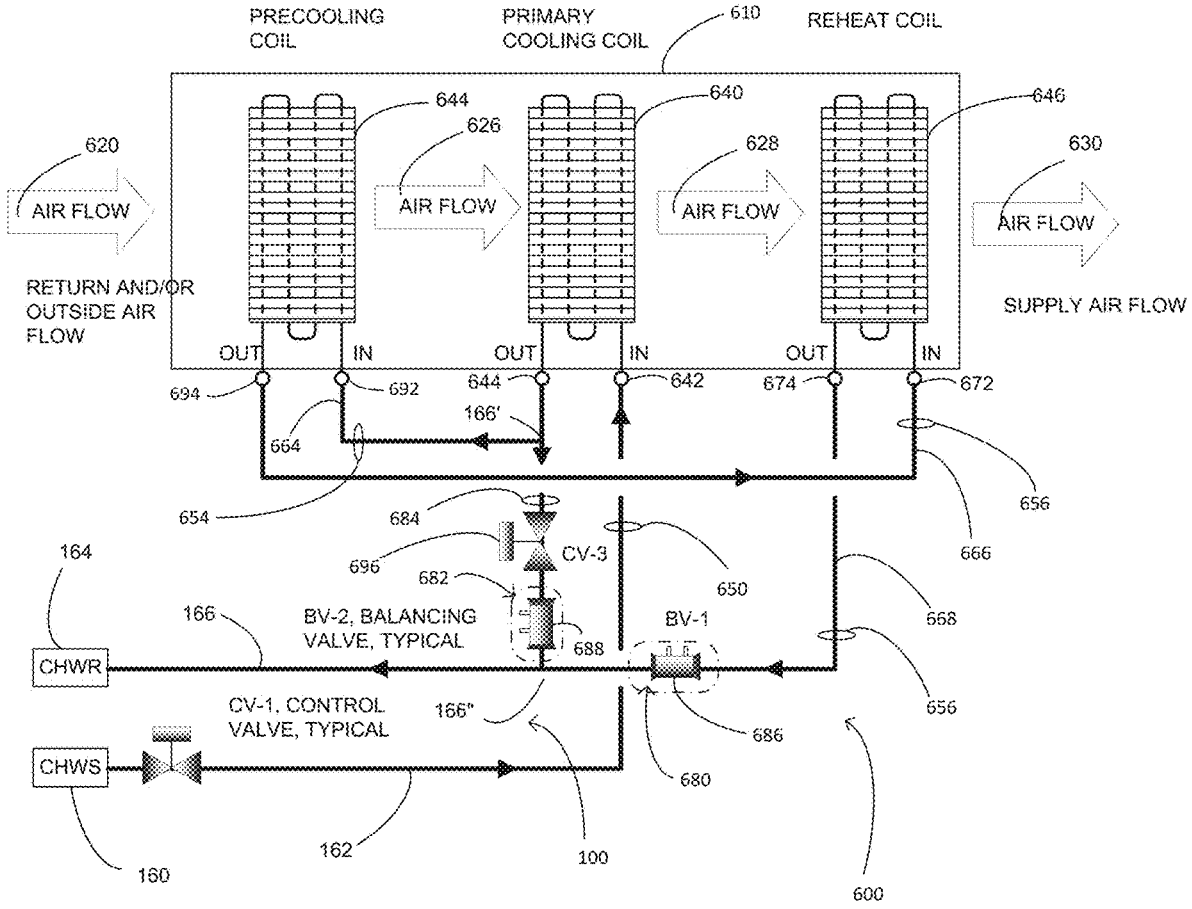
FIG. 6 illustrates a schematic view of the moisture control system of FIG. 4 with an added control valve in accordance with a third embodiment.

FIG. 6 illustrates a schematic view of the moisture control system of FIG. 4 with an added control valve in accordance with a third embodiment. Referring to FIG. 6 a control valve, CV-3, is added to the system illustrated in FIG. 4. This valve is used to regulate the amount of working fluid 650 allowed to transfer to the precooling coil inlet 692 or allowed to continue to the connection 166" of the chilled water return conduit 166. When the control valve CV-3 is open the chilled water flow to precooling coil inlet 692 and to the return chilled water connection 166" will be in the proportions as manually set by the positions of the balancing valve BV-1 and BV-2. When the control valve CV-3 is closed 100% of the chilled water flow will transfer to precooling coil. When there is full chilled water flow through the precooling coil, the water temperature increase by action of the precooling function will not increase enough to provide a useful reheat ability. Closing the valve CV-3 will provide increased cooling of the air flow by virtue of the increased chilled water flow to the coil. So using the regulation of the valve CV-3 will provide an increase or decrease in sensible cooling and an increase or decrease in latent cooling as illustrated in the sample calculations that follow.

The embodiment of FIG. 6 is particularly well-suited and finds particular use in applications where the flow 654/656 needs to be regulated.

The embodiment is beneficial because a variable temperature and or relative humidity of the supply air flow 630 may be desired to control a process or maintain room conditions.

It has advantages over the earlier systems such as those shown in FIG. 1 including it has a means of adding heat to the air flow 628 to raise the air temperature to that required at flow 630.

It has further advantages over the earlier systems such as those shown in FIG. 2 including the heat for raising the temperature of the air flow 628 is recovered heat from the precooling process.

FIG. 6 shows a moisture control system 600 in accordance with an example embodiment for use with an associated two-pipe chilled water air conditioning system 100 including an associated cooling coil 640 where a working fluid 650 flowing through the cooling coil 640 absorbs thermal energy from a return air flow 620 as a cooled supply air flow 630, an associated chilled water source conduit 162 delivering the working fluid 650 from an associated chilled water source 160 to the cooling coil 640, and an associated chilled water return conduit 166 returning the working fluid 650 from the cooling coil 640 to an associated chilled water return 164. In the illustration of the example embodiment shown, the moisture control apparatus 600 includes a precooling coil 690 in the return air flow 620, a reheat coil 670 in the supply air flow 630, a wrap-around fluid conduit 664, 666, and a regulator circuit 680. The precooling coil 690 receives a first portion 654 of the working fluid 650 and exchanges thermal energy between the return air flow 620 and the first portion 654 of the working fluid 650 flowing through the precooling coil 690. The reheat coil 670 receives a second portion 656 of the working fluid 650 and exchanges thermal energy between the second portion 656 of the working fluid 650 flowing through the reheat coil 670 and the supply air flow 630. The wrap-around fluid conduit 664, 666 is in operative fluid communication with the associated chilled water return conduit 166, the precooling coil 690, and the reheat coil 670. The wrap-around fluid conduit 664, 666 containedly directs the first and second portions 654, 656 of the working fluid 650 through a series arrangement of an input 166' of the wrap-around fluid conduit 664, 666, the precooling coil 690, the reheat coil 670, and the associated chilled water return conduit 166. The regulator circuit 680 is operatively coupled with the input 166' of the wrap-around fluid conduit 664, 666 and with the associated chilled water return conduit 166. The regulator circuit 680 meters the first portion 654 of the working fluid 650 from the associated chilled water return conduit 166 for communication of the first portion 654 of the working fluid 650 to the input 166' of the wrap-around fluid conduit 664, 666.

It is to be appreciated that in the example embodiment, the precooling coil 690 of the example moisture control system 600 includes an input 692 in operative fluid communication with the associated chilled water return conduit 166, and the reheat coil 670 similarly includes an output 674 in operative fluid communication with the associated chilled water return conduit 166. Preferably, the wrap-around fluid conduit 666 containedly directs all of the first portion 656 of the working fluid 650 from an output 694 of the precooling coil 690 to an input 672 of the reheat coil 670 as the second portion 656 of the working fluid 650. The wrap-around fluid conduit 668 further preferably containedly directs all of the second portion 656 of the working fluid 650 from the output 674 of the reheat coil 670 to the associated chilled water return conduit 166 for return of the second portion 656 of the working fluid 650 to the associated chilled water return 164.

In an embodiment, the regulator circuit 680 of the moisture control system 600 includes a balancing valve system 686. Preferably the balancing valve system 686 is disposed at a fluid connection between the associated chilled water return conduit 166 and the input 166' of the wrap-around fluid conduit 664, 666. In that way, the maximum working fluid flow 650 to the return 164 can be balanced to the desired value by closing the automatic control valve 696 then adjusting the balancing valve 686 to the desired value 650.

In a particular example embodiment, the balancing valve system 686 of the regulator circuit 680 of the subject example moisture control system 600 includes first and second manual balancing valves 686, 688. The first manual balancing valve 686 is disposed between a first connection 664' to the associated chilled water return conduit 166 and the input 166' of the wrap-around fluid conduit 664, 666. In its preferred form, the first manual balancing valve 686 is adjustable to control a flow volume of the working fluid 650 entering the input 166' of the wrap-around fluid conduit 664, 666 as the first portion of the working fluid 650. Also in its preferred form, the second manual balancing valve 688 is disposed in-line in the associated chilled water return conduit 166 between the first connection 664' to the associated chilled water return conduit 166 and the associated chilled water return 164. The second manual balancing valve 688 is adjustable to control a pressure of the working fluid 650 at the first connection 664'.

Operationally, the regulator circuit 680 of the subject example moisture control system 600 meters the first portion 654 of the working fluid 650 from the associated chilled water return conduit 166 for communication of the first portion 654 of the working fluid 650 to the input 692 of the precooling coil 690.

The moisture control system 600 according to a further example embodiment includes the components described above in combination with the cooling coil 640, the chilled water source conduit 162 delivering the working fluid 650 from the associated chilled water source 160 to the cooling coil 640, and the chilled water return conduit 166 returning the working fluid 650 from the cooling coil 640 to the associated chilled water return.

Yet still further, in accordance with the example embodiment, the regulator circuit 680 of the moisture control system 600 includes an automatic throttling valve 696 disposed in series with the second manual balancing valve 686 between the first connection 664' to the associated chilled water return conduit 166 and the associated chilled water return 164. The automatic throttling valve 696 is responsive to a control signal from an associated control device to selectively throttle a flow of the working fluid 684 passing from the output 644 of the associated cooling coil 640 and not being directed to the precooling coil 690 as the first portion 654 of the working fluid 650 flowing through the precooling coil 690.

Figure 7:
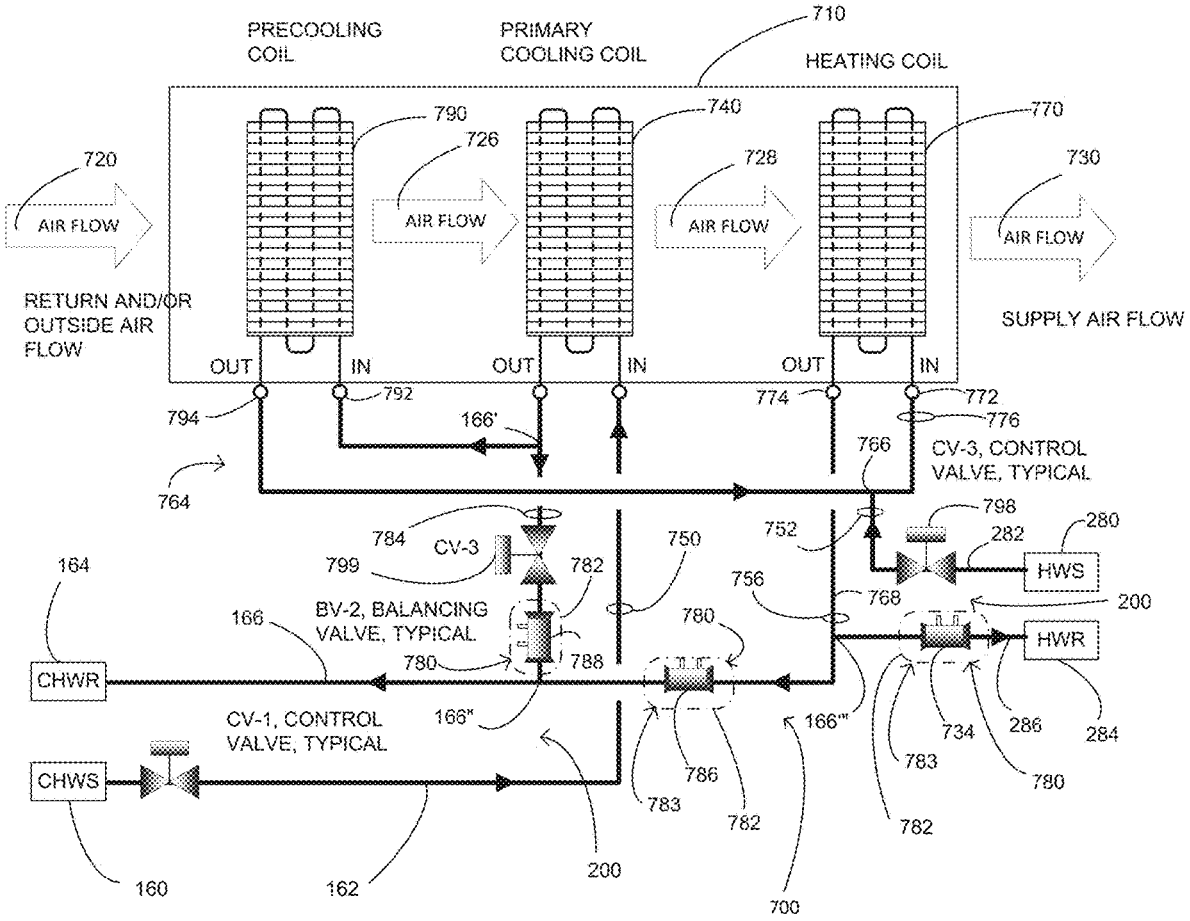
FIG. 7 illustrates a schematic view of the moisture control system of FIG. 5 with an added control valve in accordance with a fourth embodiment.

FIG. 7 illustrates a schematic view of the moisture control system of FIG. 5 with an added control valve in accordance with a fourth embodiment. Referring to FIG. 7 a heat source is added to the piping system of FIG. 6. The benefit and operation of the is as described for the system illustrated in FIG. 5.

The embodiment of FIG. 7 is particularly well-suited and finds particular use in applications where a variable temperature of the supply air flow is desired above which can be provided by the heat from the precooling process.

The embodiment is beneficial because heat available from a heat source 280 can be added to the heat from the precooling process to provide an increase in the temperature of the supply air flow.

It has advantages over the earlier systems such as those shown in FIG. 1 including a hot water source for a reheat process to raise the temperature and lower the relative humidity of the supply air flow 730.

It has further advantages over the earlier systems such as those shown in FIG. 2 including the use of the heat transferred from the air in the precooling process which becomes the first heat for the reheat process in the reheat coil and which said heat transfer in the precooling process causes a reduction of heat in the chilled water working fluid thereby reducing the requirement of cooling in the chilled water central plant (not shown).

FIG. 7 shows a moisture control system 700 in accordance with a further example embodiment for use with an associated four-pipe chilled water air conditioning system 200 including an associated cooling coil 740 where a cold working fluid 750 flowing through the associated cooling coil 740 absorbs thermal energy from a return air flow 720 as a cooled supply air flow 730, an associated reheat coil 770 where a warm working fluid 752 flowing through the reheat coil 770 adds thermal energy to the cooled supply air flow 730 as a reheated supply air flow 730, an associated chilled water source conduit 162 delivering the cold working fluid 750 from an associated chilled water source 160 to the cooling coil 740 an associated chilled water return conduit 166 returning the cold working fluid 750 from the cooling coil 740 to an associated chilled water return 164, an associated hot water source conduit 282 delivering the warm working fluid 752 from an associated hot water source 280 to the reheat coil 770, an associated hot water return conduit 286 returning the warm working fluid 752 from the reheat coil 770 to an associated hot water return 284. In the illustration of the example embodiment shown, the moisture control apparatus 700 includes a precooling coil 790 in the return air flow 720, a wrap-around fluid conduit 764, and a regulator circuit 780. The precooling coil 790 receives a first portion 754 of the cold working fluid 750 and exchanges thermal energy between the return air flow 720 and the first portion 754 of the cold working fluid 750 flowing through the precooling coil 790.

The wrap-around fluid conduit 764 of the example embodiment is in operative fluid communication with the associated chilled water return conduit 166, the precooling coil 790, the associated reheat coil 770, and the hot water return conduit 286. The wrap-around fluid conduit 764 containedly directs the first portion 754 of the cold working fluid 750 through a series arrangement of an input 166' of the wrap-around fluid conduit 764, the precooling coil 790, and the associated reheat coil 770.

The regulator circuit 780 of the example embodiment is operatively coupled with the input 166' of the wrap-around fluid conduit 764 and with the associated chilled water return conduit 166. Functionally, the regulator circuit 780 meters the first portion 754 of the cold working fluid 750 from the associated chilled water return conduit 166 for communication of the first portion 754 of the cold working fluid 750 to the input 166' of the wrap-around fluid conduit 764.

In particular and as shown, in the subject example embodiment, the precooling coil 790 of the moisture control system 700 includes an input 792 in operative fluid communication with the associated chilled water return conduit 166 via the wrap-around fluid conduit 764. Further, the wrap-around fluid conduit 764 is configured to containedly direct all of the first portion 756 of the cold working fluid 750 from an output 794 of the precooling coil 790 to an input 772 of the associated reheat coil 770. Yet still further, the wrap-around fluid conduit 764 of the example embodiment includes a bridge conduit portion 766 fluidically coupling the associated chilled water return conduit 166 with the associated hot water source conduit 282.

In its preferred form, the regulator circuit 780 of the moisture control system 700 according to the example embodiment illustrated includes a balancing valve system 782. Preferably, the balancing valve system 782 is disposed at a fluid connection between: the input 166' of the wrap-around fluid conduit 764, a first connection 166" to the associated chilled water return conduit 166; an output 774 of the reheat coil 770; and the associated hot water return conduit 286.

In one form of the example embodiment, the balancing valve system 782 of the regulator circuit 780 of the moisture control system 700 includes a first balancing valve 788, and a blending regulator 783. As shown, the first balancing valve 788 is disposed in-line between the input 166' of the wrap-around fluid conduit 764 and the first connection 166" to the associated chilled water return conduit 166. Further as shown, the blending regulator 783 is disposed at the connection between the associated hot water return conduit 286, the output 774 of the reheat coil 770, and the first connection 166" to the associated chilled water return conduit 166.

It is preferred that the first balancing valve 788 of the moisture control system 700 according to the example embodiment is adjustable to control a flow volume of the cold working fluid 750 entering the input 166' of the wrap-around fluid conduit 764 as the first portion 754 of the cold working fluid 750. In that way, the minimum first portion of the working fluid 950 is directed to the wrap-around conduit, precooling coil 940 and reheat coil 970.

Yet still further as shown, the blending regulator 783 of the moisture control system 700 according to the example embodiment includes second and third balancing valves 734, 786. The second balancing valve 734 of the blending regulator 783 is disposed between the associated hot water return conduit 286 and a second connection 166'" to the associated chilled water return conduit 166. The second balancing valve 734 is adjustable to control a flow volume of a blend of the warm and cold working fluids being returned to the associated hot water return 284. Similarly, the third balancing valve 786 of the blending regulator 783 is disposed between the first and second connections 166", 166'" to the associated chilled water return conduit 166, the third balancing valve 786 being adjustable to control a flow volume of the blend of the warm and cold working fluids being returned to the associated cold water return 164.

The various components of the example embodiment are preferably plumbed as shown. More particularly, the output 774 of the reheat coil 770 is in fluid communication with the associated hot water return conduit 286 via the second balancing valve 734. Somewhat similarly, the output 774 of the reheat coil 770 is in fluid communication with the associated chilled water return 164 via the third balancing valve 786.

An automatic throttling valve 798 is further provided in the regulator circuit 782 of the moisture control system 700 according to the embodiment illustrated. As shown, the automatic throttling valve 798 is disposed between the associated hot water source conduit 282 and the wrap-around fluid conduit 764. Functionally, the automatic throttling valve 798 is responsive to a control signal from an associated control device to throttle a flow of the warm working fluid 752 entering into the associated reheat coil 770 via the wrap-around fluid conduit 764.

In particular and with continued reference to the embodiment shown in FIG. 7, the regulator circuit 780 of the moisture control system 700 further includes a second automatic throttling valve 799 disposed in series with the first balancing valve 788. The second automatic throttling valve 799 is responsive to a control signal from an associated control device to throttle a flow of the cold working fluid (750) being returned to the associated cold water return 164.

Figure 8:
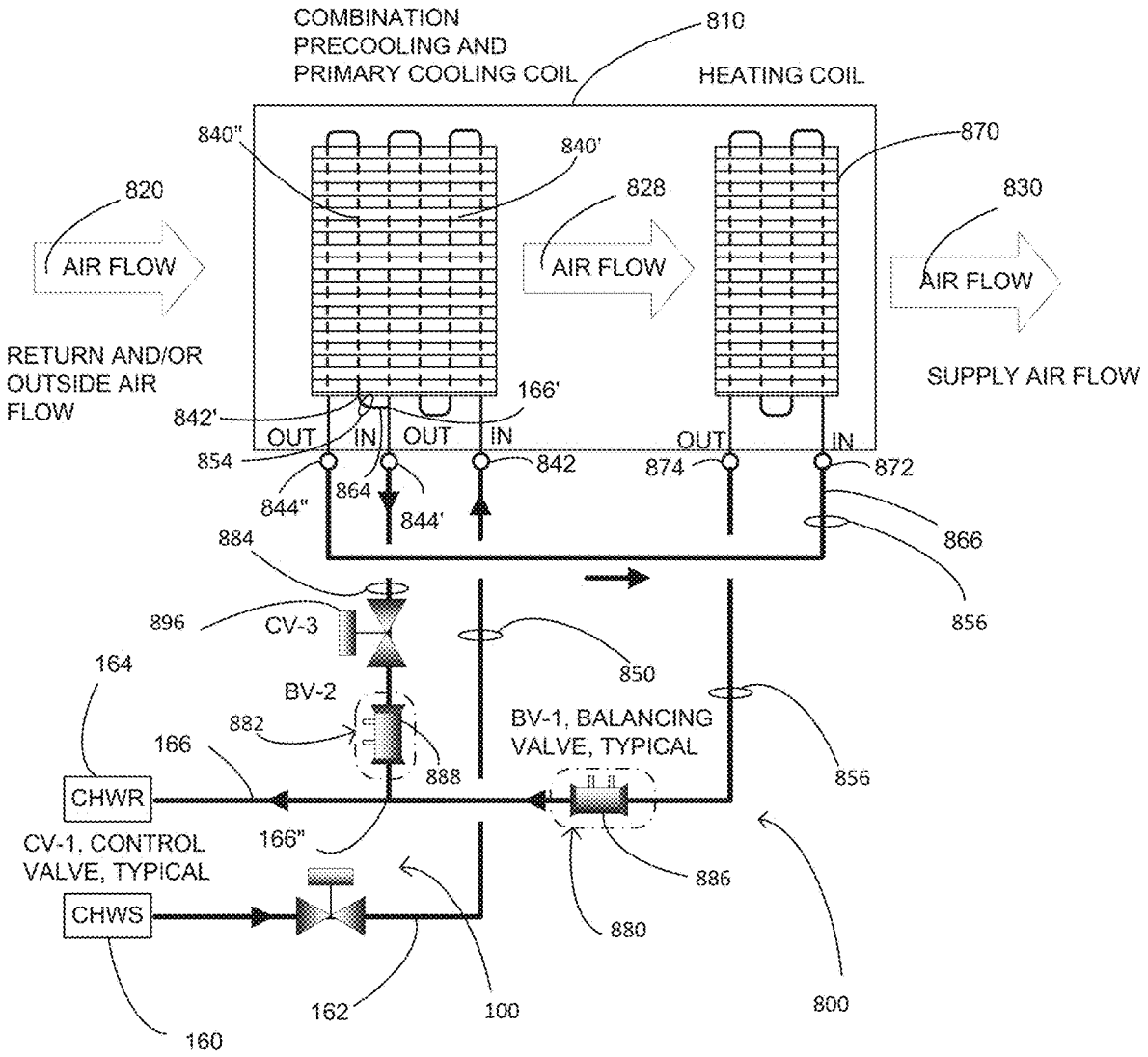
FIG. 8 illustrates a schematic view of a moisture control system with combined precooling and primary cooling coils integrated into a single composite coil and operable with an associated two-pipe chilled water system for latent heat extraction in accordance with a fifth embodiment.

FIG. 8 illustrates a schematic view of a moisture control system with combined precooling and primary cooling coils integrated into a single composite coil and operable with an associated two-pipe chilled water system for latent heat extraction in accordance with a fifth embodiment. Referring to FIG. 8 the precooling and primary cooling coil of FIG. 4 and FIG. 6 are combined into a single coil. FIG. 8 illustrates the system piping 600 of FIG. 6. The system piping 600 can be either as shown in FIG. 4 or as shown in FIG. 6. The operation of the system shall be as described above for FIG. 4 and FIG. 6. Using a combined coil will save space in the coil compartment of the air handling unit and thereby save space in equipment rooms as applicable. The combining of the two coils will also save in manufacturing costs since the fabrication will be of only one coil, although larger, would be less than the fabrication of two individual smaller coils.

The embodiment of FIG. 8 is particularly well-suited and finds particular use in applications where the flow 854/856 needs to be regulated.

The embodiment is beneficial because a variable temperature and or relative humidity of the supply air flow 830 may be desired to control a process or maintain room conditions.

It has advantages over the earlier systems such as those shown in FIG. 1 including it has a means of adding heat to the air flow 828 to raise the air temperature to that required at flow 830.

It has further advantages over the earlier systems such as those shown in FIG. 2 including the heat for raising the temperature of the air flow 828 is recovered heat from the precooling process.

The moisture control system 800 of the example embodiment of FIG. 8 is provided for use with an associated two-pipe chilled water air conditioning system 100 delivering a working fluid 850 flowing from an associated chilled water source 160 via an associated chilled water source conduit 162 and returning the working fluid 850 to an associated chilled water return 164 via an associated chilled water return conduit 166. The moisture control apparatus 800 of the embodiment includes an air treatment coil 840, a reheat coil 870 in the supply air flow 830, a wrap-around fluid conduit 866, and a regulator circuit 880 operatively coupled with an input 844" of the wrap-around fluid conduit 866 and with the associated chilled water return conduit 166. In the example embodiment, the air treatment coil 840 includes a housing 810 configured to receive a return air flow 820 into the housing 810 and to exhaust the return air flow from the housing as a cooled supply air flow 830, a plurality of cooling fins disposed in the housing, a cooling coil portion 840' mechanically and thermally coupled with the plurality of cooling fins, and a precooling coil portion 840" in the return air flow 820 and mechanically and thermally coupled with the plurality of cooling fins. The cooling coil portion 840' is in operative fluid communication with the associated chilled water source conduit 166, and as such receives the working fluid 850 from the associated chilled water source 160 via the associated chilled water source conduit 162 and flows the working fluid therethrough thereby absorbing thermal energy from the return air flow 820 as the cooled supply air flow 830.

The precooling coil portion 840" receives a first portion 854 of the working fluid 850 and exchanges thermal energy between the return air flow 820 and the first portion 854 of the working fluid 850 flowing through the precooling coil portion 840", wherein an input of the precooling coil portion 840" is in fluid communication with an output port 844" of the cooling coil portion 840'.

The reheat coil 870 of the example embodiment receives a second portion 854 of the working fluid 850, and exchanges thermal energy between the second portion 854 of the working fluid 850 flowing through the reheat coil 870 and the supply air flow 830.

The wrap-around fluid conduit 866 of the example embodiment is in operative fluid communication with the associated chilled water return conduit 166, the precooling coil portion 840", and the reheat coil 870. The wrap-around fluid conduit 866 containedly directs the first and second portions 854, 856 of the working fluid 850 through a series arrangement of an input 842 of the wrap-around fluid conduit 866, the precooling coil portion 840", the reheat coil 870, and the associated chilled water return conduit 166.

The regulator circuit 880 of the example embodiment is operative to meter the first portion 854 of the working fluid 850 from the associated chilled water return conduit 166 for communication of the first portion 854 of the working fluid 850 to the input 844" of the wrap-around fluid conduit 866.

The precooling coil portion 840" of the moisture control system 800 of the example embodiment includes an input 842' in operative fluid communication with the associated chilled water return conduit 166. The reheat coil 870 comprises an output 874 in operative fluid communication with the associated chilled water return conduit 166. Further and as shown, the wrap-around fluid conduit 866 includes a bypass fluid conduit 864' operatively coupled between an output 844' of the cooling coil portion 840" and the input 842' of the precooling coil portion 840". The wrap-around fluid conduit 866 containedly directs all of the first portion 854 of the working fluid 850 from an output 844' of the precooling coil portion 840" to an input 872 of the reheat coil 870 as the second portion 856 of the working fluid 850. The wrap-around fluid conduit 866 further containedly directs all of the second portion 856 of the working fluid 850 from the output 874 of the reheat coil 870 to the associated chilled water return conduit 166 for return of the second portion 856 of the working fluid 850 to the associated chilled water return 164.

Preferably and as shown, the regulator circuit 880 of the moisture control system 800 according to the example embodiment includes a balancing valve system 886 disposed between the bypass fluid conduit 864 and the associated chilled water return conduit 166.

For precise moisture control, the balancing valve system 886 of the regulator circuit 880 of the control system 800 according to the example embodiment shown includes first and second balancing valves 886, 888. The first balancing valve 886 is a first manual balancing valve 886 disposed between the bypass fluid conduit 864 and the associated chilled water return conduit 166. The first balancing valve 886 is adjustable to control a flow volume of the first portion 854 of the working fluid 850 flowing through the precooling coil portion 840" and the reheat coil 870. Similarly, the second balancing valve 888 is a manual balancing valve 888 disposed in the series arrangement between the input 166' of the wrap-around fluid conduit 864 and the associated chilled water return conduit 166. The second manual balancing valve 888 is adjustable to control a pressure of the working fluid 850 at the wrap-around fluid conduit 864.

As shown, the regulator circuit 882 of the moisture control system 800 of the example embodiment includes an automatic throttling valve 896 disposed in series with the second manual balancing valve 888 between the wrap-around fluid conduit 864 and the associated chilled water return conduit 166. The automatic throttling valve 896 of the example embodiment is responsive to a control signal from an associated control device to throttle a flow of the working fluid 850 passing from the output 844' of the cooling coil portion 840' of the air treatment coil 840 and not being directed to the precooling coil portion 840" of the air treatment coil 840 as the first portion 854 of the working fluid 850 flowing through the precooling coil portion 840".

Figure 9:
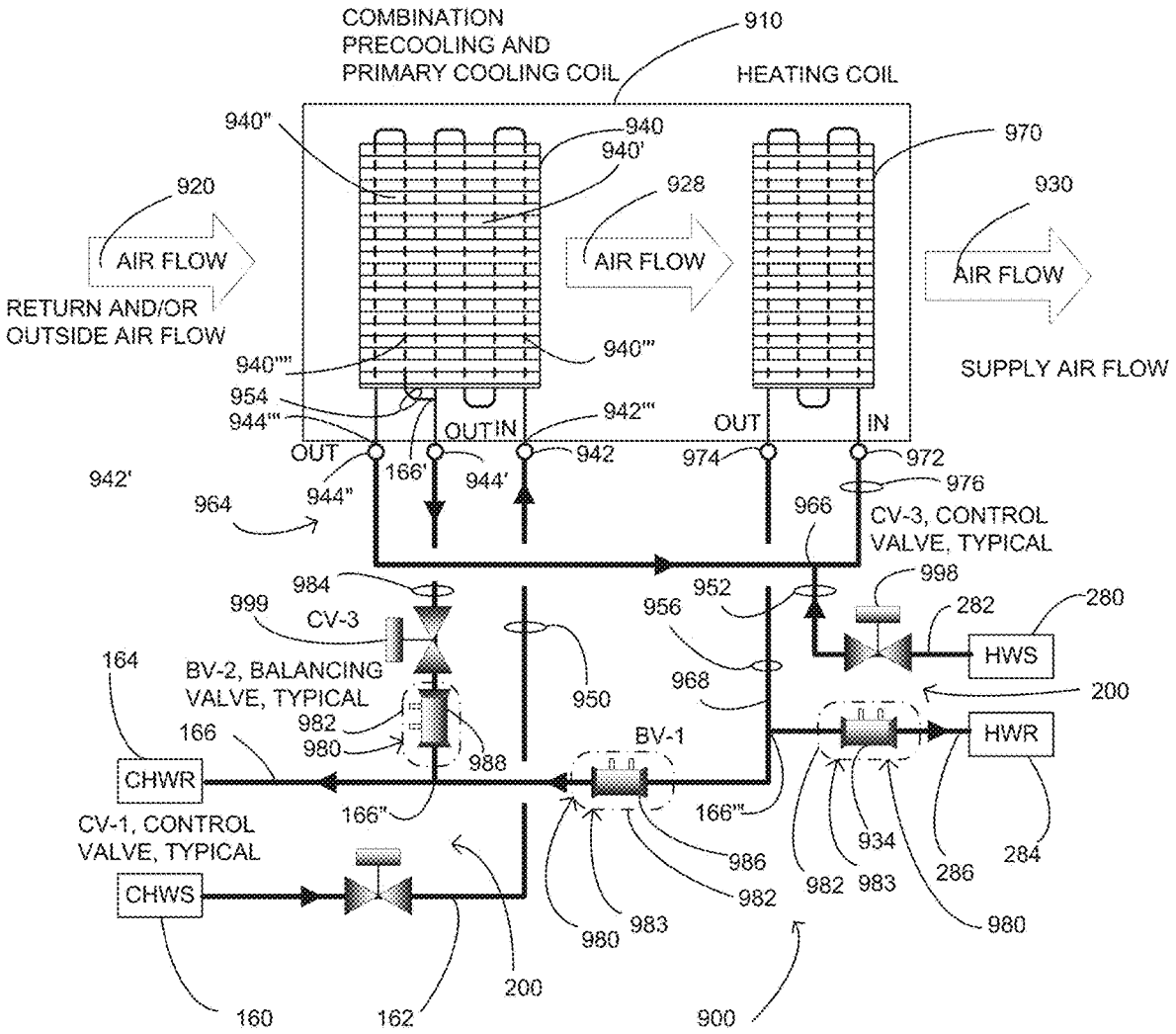
FIG. 9 illustrates a schematic view of a moisture control system with combined precooling and primary cooling coils integrated into a single composite coil and operable with an associated four-pipe chilled water system for latent heat extraction in accordance with a sixth embodiment.

FIG. 9 illustrates a schematic view of a moisture control system with combined precooling and primary cooling coils integrated into a single composite coil and operable with an associated four-pipe chilled water system for latent heat extraction in accordance with a sixth embodiment. Referring to FIG. 9 a heat source is added to the piping system of FIG. 8. The benefit and operation of the moisture control system is as described for the system illustrated in FIGS. 5 and 7.

In general, the primary cooling coil section 940' is the leaving air end of the combined cooling coil 940. Chilled water 950 flows from the coil inlet header 942 to the primary coil circuit inlets 942'" to the primary coil circuits 940'".

The coil circuits inlet attach to the primary cooling circuits 942". There are multiple circuits in the cooling coil. The number of 940" circuits in the primary cooling coil section 940' are established by manufacturing practice to optimize the performance of primary cooling coil section 940' of the combined cooling coil 940.

The coil circuits 940" flow a portion of the chilled water to the return water header 944' and also flow a first portion of working fluid 950 to the inlet of the precooling coil circuits 166'. Just as with the primary coil section 940' there are multiple circuits in the precooling coil section.

The number of circuits 940"" in the precooling cooling coil are established by manufacturing practice to optimize the performance of precooling coil section 940" of the combined cooling coil 940. The number of circuits 940"" do not necessary need to match the quantity of circuits 940'".

Balancing Valve 988 sets the minimum first portion flow through the 166' inlet to the wrap around loop conduit 964.

The first portion of chilled water flow 976, flows from individual inlets 166' to the individual precooling coil circuits 942" of the precooling coil section 940" of the combined cooling coil 940. The combined flow of each of the individual circuits will be equal to the first portion flow to working fluid 950.

The embodiment of FIG. 9 is particularly well-suited and finds particular use in applications where a variable supply air temperature at 930 supply air flow is required.

The embodiment is beneficial because the supply air temperature at 730 air flow would not be limited to that which would be provided through the use of the heat transfer from the precooling coil portion of the cooling coil alone.

It has advantages over the earlier systems such as those shown in FIG. 1 including a reheat means used to control the supply air flow 930 temperature and relative humidity.

It has further advantages over the earlier systems such as those shown in FIG. 2 including the use of a recuperative reheat/precooling system where the reclaimed heat from the precooling process provides free heat for the reheat process and the reheat process lowers the temperature of the second portion of the working fluid thereby reducing the cooling requirement of the central chilled water plant.

With reference now to FIG. 9, a moisture control system 900 is shown in accordance with an embodiment for use with an associated four-pipe air conditioning system 200. The associated four-pipe air conditioning system 200 includes an associated reheat coil 970 where a warm working fluid 952 flowing through the reheat coil 970 adds thermal energy to a cooled supply air flow 928 as a reheated supply air flow 930, an associated chilled water source conduit 162 delivering a cold working fluid 950 from an associated chilled water source 160, an associated chilled water return conduit 166 returning the cold working fluid 950 to an associated chilled water return 164, an associated hot water source conduit 280 delivering the warm working fluid 952 from an associated hot water source 260 to the reheat coil 970, and an associated hot water return conduit 286 returning the warm working fluid 952 from the reheat coil 970 to an associated hot water return 284.

The moisture control apparatus 900 of the example embodiment includes an air treatment coil 940 for treating and conditioning the air flow, a wrap-around fluid conduit 964 for circulating the working fluid, and a regulator circuit 980 for regulating the flow of the working fluid though the system. The air treatment coil 940 of the embodiment includes a housing 910 configured to receive a return air flow 920 into the housing and to exhaust the return air flow from the housing as a cooled supply air flow 930, a plurality of cooling fins (FIG. 12) disposed in the housing, a cooling coil portion 940' mechanically and thermally coupled with the plurality of cooling fins, and a precooling coil portion 940" in the return air flow 920 and being mechanically and thermally coupled with the plurality of cooling fins. The cooling coil portion 940' is in operative fluid communication with the associated chilled water source conduit 160, and receives the working fluid 950 from the associated chilled water source 160 via the associated chilled water source conduit 162 and flows the working fluid therethrough thereby absorbing thermal energy from the return air flow 920 as the cooled supply air flow 930.

The precooling coil portion 940" receives a first portion 954 of the working fluid 950 and exchanges thermal energy between the return air flow 920 and the first portion 954 of the working fluid 950 flowing through the precooling coil portion 940". In the embodiment, an input of the precooling coil portion 940" is in fluid communication with an output port 166' of the cooling coil portion 940'.

As shown, the wrap-around fluid conduit 964 is in operative fluid communication with the associated chilled water return conduit 166, the precooling coil section 940", the associated reheat coil 970, and the hot water return conduit 286. The wrap-around fluid conduit 964 is configured to containedly direct the first portion 954 of the cold working fluid 950 through a series arrangement of an input 166' of the wrap-around fluid conduit 964, the precooling coil section 940", and the associated reheat coil 970.

The regulator circuit 980 of the moisture control apparatus 900 of the example embodiment is operatively coupled with the input 166' of the wrap-around fluid conduit 964, and with the associated chilled water return conduit 166. Operationally, the regulator circuit 980 is configured to meter the first portion 954 of the cold working fluid 950 from the associated chilled water return conduit 166 for communication of the first portion 954 of the cold working fluid 950 to the input 161' of the wrap-around fluid conduit 964.

The precooling coil portion 940" of the moisture control system 900 of the example embodiment in particular includes an input 972 in operative fluid communication via the wrap-around fluid conduit 964 with the associated chilled water return conduit 166. The wrap-around fluid conduit 964 containedly directs preferably all of the first portion 954 of the working fluid 950 from an output 944" of the precooling coil portion 940" to an input 972 of the associated reheat coil 970.

The wrap-around fluid conduit 964 of the moisture control system 900 of the example embodiment in particular includes a bridge conduit portion 966 fluidically coupling the associated chilled water return conduit 166 with the associated hot water source conduit 282. In that way, the temperature of the second portion of the working fluid 950 can be mixed with the warm working fluid 976 so as to provide the desired temperature of the supply air flow 930.

It is to be appreciated that the regulator circuit 980 of the moisture control system 900 of the example embodiment includes a balancing valve system 982 disposed at a fluid connection between the input 166' of the wrap-around fluid conduit 964, a first connection 166" to the associated chilled water return conduit 166, an output 974, of the reheat coil 970, and the associated hot water return conduit 286. The configuration is beneficial to effect return working warm water fluid return 284 via conduit 286 in proportion to the warm water supply 280 via conduit 282.

The balancing valve system 982 of the regulator circuit 980 of the moisture control system 900 according to the example embodiment includes a first balancing valve 988 disposed in-line between the input 166' of the wrap-around fluid conduit 964 and the first connection 166" to the associated chilled water return conduit 166, and a blending regulator 983 disposed at the connection between the associated hot water return conduit 286, the output 974 of the reheat coil 970, and the first connection 166" to the associated chilled water return conduit 166.

It is to be appreciated that the first balancing valve 988 of the moisture control system 900 is adjustable to control a flow volume of the cold working fluid 950 entering the input 166' of the wrap-around fluid conduit 964 as the first portion 954 of the cold working fluid 950.

It is further to be appreciated that the blending regulator 983 of the moisture control system 900 according to embodiment includes second and third balancing valves 934, 986. The second balancing valve 934 is disposed between the associated hot water return conduit 286 and a second connection 166'" to the associated chilled water return conduit 166. The second balancing valve 934 is preferably adjustable to control a flow volume of a blend of the warm and cold working fluids being returned to the associated hot water return 284. The third balancing valve 986 is disposed between the first and second connections 166", 166'" to the associated chilled water return conduit 166. The third balancing valve 986 is similarly preferably adjustable to control a flow volume of the blend of the warm and cold working fluids being returned to the associated cold water return 164.

As shown, the output 974 of the reheat coil 970 of the moisture control system 900 according to embodiment is in fluid communication with the associated hot water return conduit 286 via the second balancing valve 934, and is further in fluid communication with the associated chilled water return 164 via the third balancing valve 986.

Yet still further, the regulator circuit 982 of the moisture control system 900 according to the example embodiment shown includes an automatic throttling valve 998 disposed between the associated hot water source conduit 282 and the wrap-around fluid conduit 964. The automatic throttling valve 998 is responsive to a control signal from an associated control device to throttle a flow of the warm working fluid 952 entering into the associated reheat coil 970 via the wrap-around fluid conduit 964.

Figure 10:
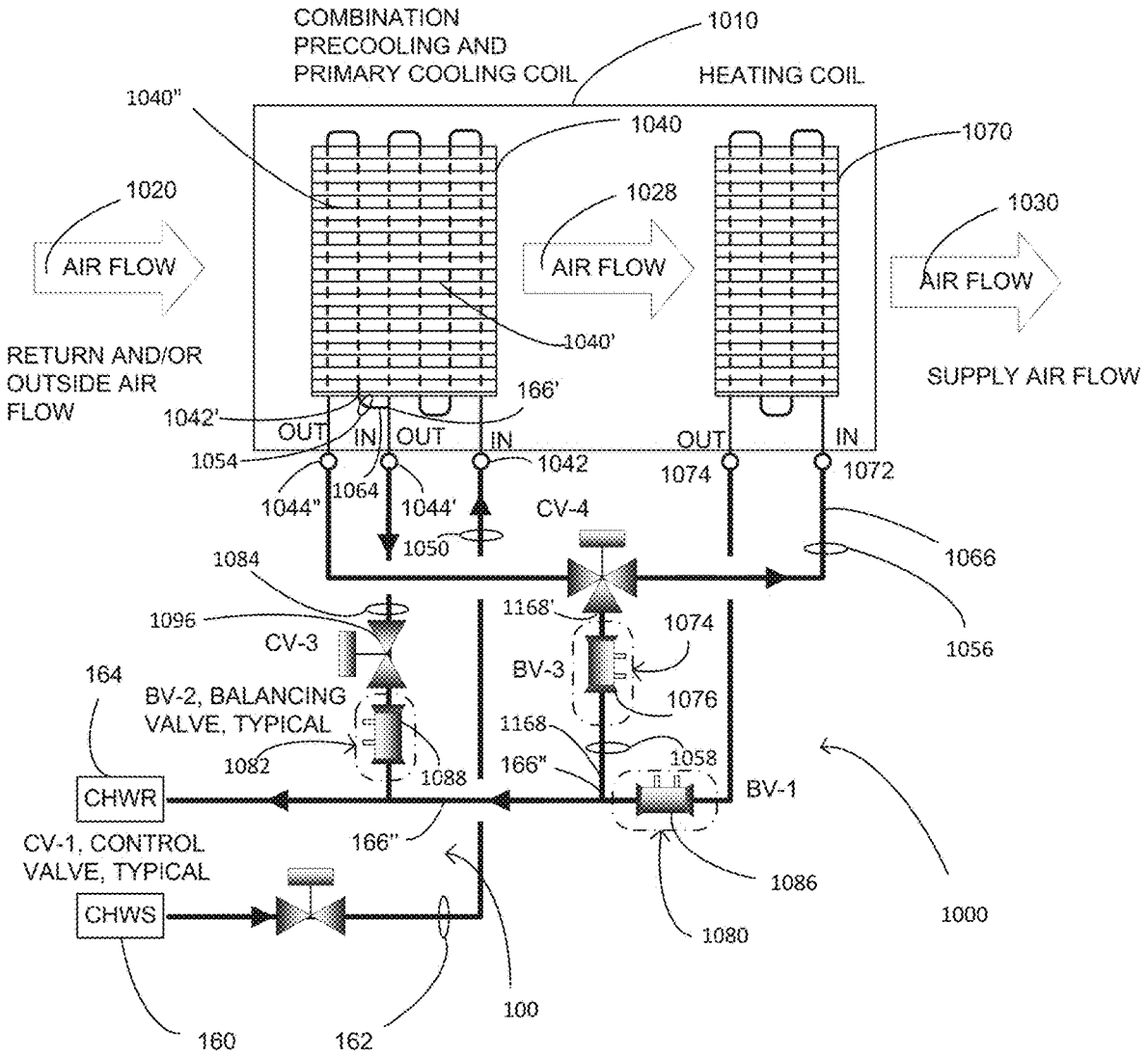
FIG. 10 illustrates a schematic view of the moisture control system of FIG. 8 with an added control valve in accordance with a seventh embodiment.

FIG. 10 illustrates a schematic view of the moisture control system of FIG. 8 with an added control valve in accordance with a seventh embodiment. Referring to FIG. 10 a valve CV-4 is added to the piping system 1000. The purpose of this valve is to by-pass the warm water around the reheat coil when there is no demand for reheat from the air conditioning system. When there is a demand for reheat the valve is positioned for flow to the inlet of the reheat coil 1072. The flow is manually balanced by presetting the balancing valve BV-1. When there is no demand for reheat the valve, CV-4, is positions for flow to BV-3 which is balanced for the desired flow from the precooling coil at point e which may be greater to provide an increase in cooling than when the valve is positioned for flow through the reheat coil. This operation is useful for changing the air conditioning system sensible heat factor (SHF) which is further explained in the included example.

The embodiment of FIG. 10 is particularly well-suited and finds particular use in applications where the flow 1054/1056 needs to be regulated and it is desired to automatically control the supply air temperature and relative humidity to a prescribed value.

The embodiment is beneficial because a variable temperature and or relative humidity of the supply air flow 1030 may be desired to control a process or maintain room conditions.

It has advantages over the earlier systems such as those shown in FIG. 1 including it has a means of adding heat to the air flow 1028 to raise the air temperature to that required at flow 1030.

It has further advantages over the earlier systems such as those shown in FIG. 2 including the heat for raising the temperature of the air flow 1028 is recovered heat from the precooling process.

The moisture control system 1000 of the example embodiment of FIG. 10 is provided for use with an associated two-pipe chilled water air conditioning system 100 delivering a working fluid 1050 flowing from an associated chilled water source 160 via an associated chilled water source conduit 162 and returning the working fluid 1050 to an associated chilled water return 164 via an associated chilled water return conduit 166. The moisture control apparatus 1000 of the embodiment includes an air treatment coil 1040, a reheat coil 1070 in the supply air flow 1030, a wrap-around fluid conduit 1066, and a regulator circuit 1080 operatively coupled with an input 1044" of the wrap-around fluid conduit 1066 and with the associated chilled water return conduit 166. In the example embodiment, the air treatment coil 1040 includes a housing 1010 configured to receive a return air flow 1020 into the housing 1010 and to exhaust the return air flow from the housing as a cooled supply air flow 1030, a plurality of cooling fins disposed in the housing, a cooling coil portion 1040' mechanically and thermally coupled with the plurality of cooling fins, and a precooling coil portion 1040" in the return air flow 1020 and mechanically and thermally coupled with the plurality of cooling fins. The cooling coil portion 1040' is in operative fluid communication with the associated chilled water source conduit 166, and as such receives the working fluid 1050 from the associated chilled water source 160 via the associated chilled water source conduit 162 and flows the working fluid therethrough thereby absorbing thermal energy from the return air flow 1020 as the cooled supply air flow 1030.

The precooling coil portion 1040" receives a first portion 1054 of the working fluid 1050 and exchanges thermal energy between the return air flow 1020 and the first portion 1054 of the working fluid 1050 flowing through the precooling coil portion 1040", wherein an input of the precooling coil portion 1040" is in fluid communication with an output port 1044" of the cooling coil portion 1040'.

The reheat coil 1070 of the example embodiment receives a second portion 1054 of the working fluid 1050, and exchanges thermal energy between the second portion 1054 of the working fluid 1050 flowing through the reheat coil 1070 and the supply air flow 1030.

The wrap-around fluid conduit 1066 of the example embodiment is in operative fluid communication with the associated chilled water return conduit 166, the precooling coil portion 1040", and the reheat coil 1070. The wrap-around fluid conduit 1066 containedly directs the first and second portions 1054, 1056 of the working fluid 1050 through a series arrangement of an input 1042 of the wrap-around fluid conduit 1066, the precooling coil portion 1040", the reheat coil 1070, and the associated chilled water return conduit 166.

The regulator circuit 1080 of the example embodiment is operative to meter the first portion 1054 of the working fluid 1050 from the associated chilled water return conduit 166 for communication of the first portion 1054 of the working fluid 1050 to the input 1044" of the wrap-around fluid conduit 1066.

The precooling coil portion 1040" of the moisture control system 1000 of the example embodiment includes an input 1042' in operative fluid communication with the associated chilled water return conduit 166. The reheat coil 1070 comprises an output 1074 in operative fluid communication with the associated chilled water return conduit 166. Further and as shown, the wrap-around fluid conduit 1066 includes a bypass fluid conduit 1064' operatively coupled between an output 1044' of the cooling coil portion 1040" and the input 1042' of the precooling coil portion 1040". The wrap-around fluid conduit 1066 containedly directs all of the first portion 1054 of the working fluid 1050 from an output 1044' of the precooling coil portion 1040" to an input 1072 of the reheat coil 1070 as the second portion 1056 of the working fluid 1050. The wrap-around fluid conduit 1066 further containedly directs all of the second portion 1056 of the working fluid 1050 from the output 1074 of the reheat coil 1070 to the associated chilled water return conduit 166 for return of the second portion 1056 of the working fluid 1050 to the associated chilled water return 164.

Preferably and as shown, the regulator circuit 1080 of the moisture control system 1000 according to the example embodiment includes a balancing valve system 1086 disposed between the bypass fluid conduit 1064 and the associated chilled water return conduit 166.

For precise moisture control, the balancing valve system 1086 of the regulator circuit 1080 of the control system 1000 according to the example embodiment shown includes first and second balancing valves 1086, 1088. The first balancing valve 1086 is a first manual balancing valve 1086 disposed between the bypass fluid conduit 1064 and the associated chilled water return conduit 166. The first balancing valve 1086 is adjustable to control a flow volume of the first portion 1054 of the working fluid 1050 flowing through the precooling coil portion 1040" and the reheat coil 1070. Similarly, the second balancing valve 1088 is a manual balancing valve 1088 disposed in the series arrangement between the input 166' of the wrap-around fluid conduit 1064 and the associated chilled water return conduit 166. The second manual balancing valve 1088 is adjustable to control a pressure of the working fluid 1050 at the wrap-around fluid conduit 1064.

As shown, the regulator circuit 1082 of the moisture control system 1000 of the example embodiment includes an automatic throttling valve 1096 disposed in series with the second manual balancing valve 1088 between the wrap-around fluid conduit 1064 and the associated chilled water return conduit 166. The automatic throttling valve 1096 of the example embodiment is responsive to a control signal from an associated control device to throttle a flow of the working fluid 1050 passing from the output 1044' of the cooling coil portion 1040' of the air treatment coil 1040 and not being directed to the precooling coil portion 1040" of the air treatment coil 1040 as the first portion 1054 of the working fluid 1050 flowing through the precooling coil portion 1040".

In the example embodiment in particular and as shown, the wrap-around fluid conduit 1066 of the moisture control system 1000 includes a waste conduit 1068 fluidically coupling the associated chilled water return conduit 166 at a waste connection 166" with a portion of the wrap-around fluid conduit 1066 between the output 1044" of the precooling coil 1040" and the input 1072 of the associated reheat coil 1070. Further in particular and as shown, the regulator circuit 1080 includes a second automatic throttling valve 1052 in operative fluid communication at the waste connection 166" with the wrap-around fluid conduit 1066 and with the waste conduit 1068. The second automatic throttling valve 1052 is operable responsive to a waste signal to divert a waste portion 1054' of the first portion 1054 of the working fluid 1050 from the portion of the wrap-around fluid conduit 1066 between the output 1044" of the precooling coil 1040" and the input 1072 of the associated reheat coil 1070 to the chilled water return conduit 166 via the waste conduit. In that way, the first portion of the working fluid 1050 may be automatically diverted from the reheat coil 1070 beneficially for controlling the temperature and relative humidity of the supply air flow 1030.

Further in the example embodiment in particular and as shown, the regulator circuit 1074 of the moisture control system 1000 according to the example embodiment includes a third balancing valve 1076 disposed in series with the second automatic throttling valve 1052 between the waste connection 166" and the associated chilled water return conduit 166. In the form illustrated, the third balancing valve 1076 is a manual balancing valve and is adjustable to control a flow volume of the waste portion 1058 of the first portion 1056 of the working fluid 1050 diverted from the portion of the wrap-around fluid conduit 1066 between the output 1044" of the precooling coil 1040" and the input 1072 of the associated reheat coil 1070 to the chilled water return conduit 166 via the waste conduit 1068. In that way, the waste flow 1058 may beneficially be adjusted to the desired maximum waste volume 1958.

Figure 11:
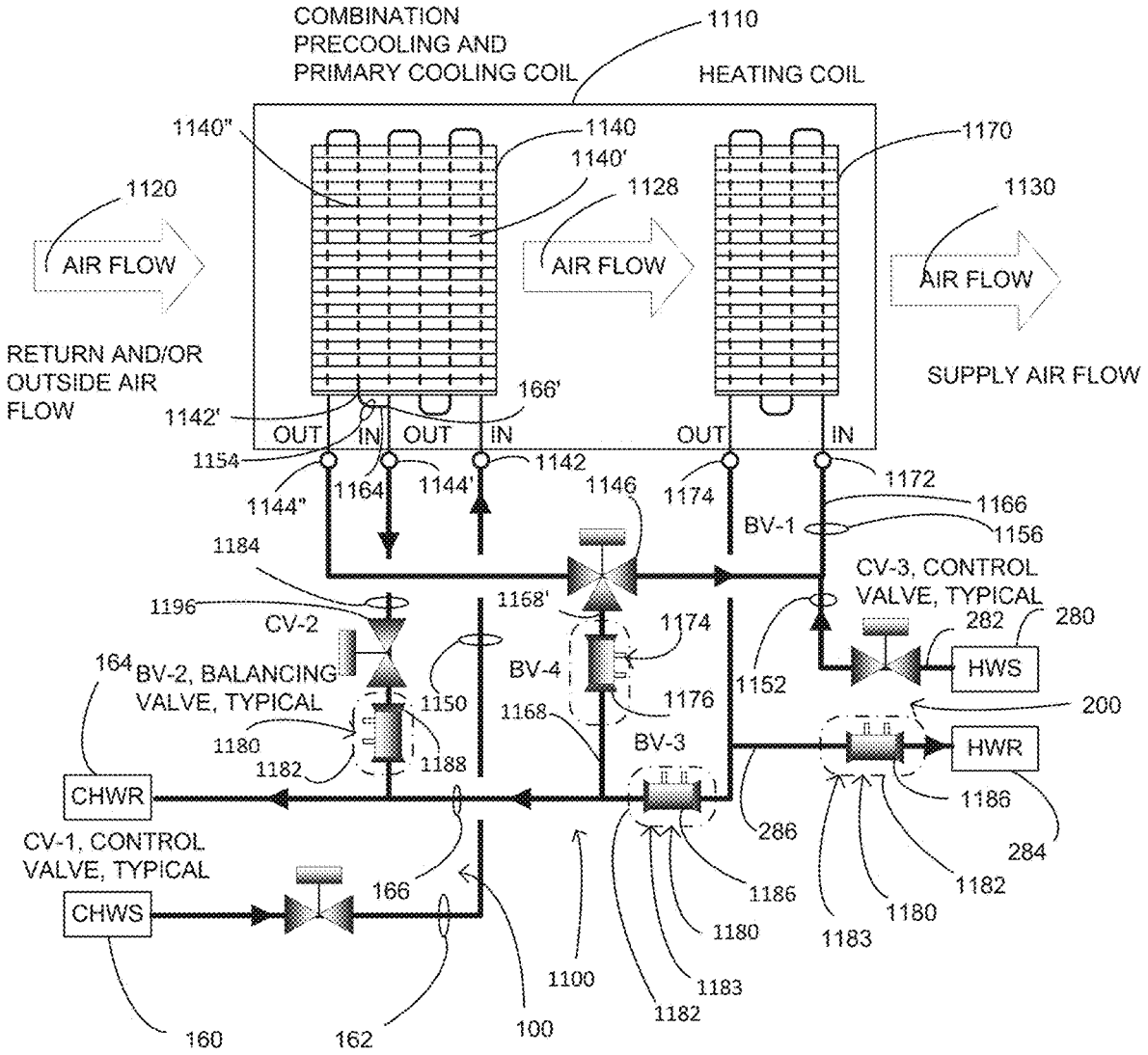
FIG. 11 illustrates a schematic view of the moisture control system of FIG. 9 with an added control valve in accordance with a eight embodiment.

FIG. 11 illustrates a schematic view of the moisture control system of FIG. 9 with an added control valve in accordance with a eight embodiment. Referring to FIG. 11 a heat source is added to the piping system of FIG. 10. The benefit and operation of the moisture control system is as described for the system illustrated in FIGS. 5 and 7.

The embodiment of FIG. 11 is particularly well-suited and finds particular use in applications where it is desired to introduce heat to the air flow 1128 to maintain a temperature in air flow 1130 via heat transfer from the water flow in the reheat coil 1170 this to either supplement the heat available from the precooling coil section 1140' of the combined cooling coil 1140 or to provide heat for maintaining the temperature of the supply air 1130 such as for winter space heating purposes.

The embodiment is beneficial because the temperature of the supply air flow 1130 can be maintained automatically for all reasonably expected temperature conditions of the return or outside air flow 1120.

It has advantages over the earlier systems such as those shown in FIG. 1 including a precise means of transferring heat from the return or outside air 1120 and/or a heating source 280 for the beneficial application of heating the air flow 1128 via the reheat coil 1170 to the desired temperature in the air flow 1130.

It has further advantages over the earlier systems such as those shown in FIG. 2 including because the first source of heat transfer for maintaining the temperature of air flow 1130 is recovered heat from the precooling process of 1140" precooling coil section thereby conserving heat by reducing the flow from the heat source 280 and conserving cooling by reducing the working fluid temperature at 164.

With reference now to FIG. 11, a moisture control system 1100 is shown in accordance with an embodiment for use with an associated four-pipe air conditioning system 100. The associated four-pipe air conditioning system 100 includes an associated reheat coil 1170 where a warm working fluid 1152 flowing through the reheat coil 1170 adds thermal energy to a cooled supply air flow 1132 as a reheated supply air flow 1134, an associated chilled water source conduit 162 delivering a cold working fluid 1150 from an associated chilled water source 160, an associated chilled water return conduit 166 returning the cold working fluid 1150 to an associated chilled water return 164, an associated hot water source conduit 282 delivering the warm working fluid 1152 from an associated hot water source 260 to the reheat coil 1170, and an associated hot water return conduit 286 returning the warm working fluid 1152 from the reheat coil 1170 to an associated hot water return 284.

The moisture control apparatus 1100 of the example embodiment includes an air treatment coil 1140 for treating and conditioning the air flow, a wrap-around fluid conduit 1164 for circulating the working fluid, and a regulator circuit 1180 for regulating the flow of the working fluid though the system. The air treatment coil 1140 of the embodiment includes a housing 1110 configured to receive a return air flow 1120 into the housing and to exhaust the return air flow from the housing as a cooled supply air flow 1130, a plurality of cooling fins (FIG. 12) disposed in the housing, a cooling coil portion 1140' mechanically and thermally coupled with the plurality of cooling fins, and a precooling coil portion 1140" in the return air flow 1120 and being mechanically and thermally coupled with the plurality of cooling fins. The cooling coil portion 1140' is in operative fluid communication with the associated chilled water source conduit 160, and receives the working fluid 1150 from the associated chilled water source 160 via the associated chilled water source conduit 162 and flows the working fluid therethrough thereby absorbing thermal energy from the return air flow 1120 as the cooled supply air flow 1130.

The precooling coil portion 1140" receives a first portion 1154 of the working fluid 1150 and exchanges thermal energy between the return air flow 1120 and the first portion 1154 of the working fluid 1150 flowing through the precooling coil portion 1140". In the embodiment, an input of the precooling coil portion 1140" is in fluid communication with an output port 166' of the cooling coil portion 1140'.

As shown, the wrap-around fluid conduit 1164 is in operative fluid communication with the associated chilled water return conduit 166, the precooling coil 1140, the associated reheat coil 1170, and the hot water return conduit 286. The wrap-around fluid conduit 1164 is configured to containedly direct the first portion 1154 of the cold working fluid 1150 through a series arrangement of an input 166' of the wrap-around fluid conduit 1164, the precooling coil 1140, and the associated reheat coil 1170.

The regulator circuit 1180 of the moisture control apparatus 1100 of the example embodiment is operatively coupled with the input 166' of the wrap-around fluid conduit 1164, and with the associated chilled water return conduit 166.

Operationally, the regulator circuit 1180 is configured to meter the first portion 1154 of the cold working fluid 1150 from the associated chilled water return conduit 166 for communication of the first portion 1154 of the cold working fluid 1150 to the input 161' of the wrap-around fluid conduit 1164.

The precooling coil portion 1140" of the moisture control system 1100 of the example embodiment in particular includes an input 1192 in operative fluid communication via the wrap-around fluid conduit 1164 with the associated chilled water return conduit 166. The wrap-around fluid conduit 1164 containedly directs preferably all of the first portion 1154 of the working fluid 1150 from an output 1144" of the precooling coil portion 1140" to an input 1172 of the associated reheat coil 1170.

The wrap-around fluid conduit 1164 of the moisture control system 1100 of the example embodiment in particular includes a bridge conduit portion 1166 fluidically coupling the associated chilled water return conduit 166 with the associated hot water source conduit 282. In that way, the minimum first portion of the working fluid 950 is directed to the wrap-around conduit, precooling coil 940 and reheat coil 970.

It is to be appreciated that the regulator circuit 1180 of the moisture control system 1100 of the example embodiment includes a balancing valve system 1182 disposed at a fluid connection between the input 166' of the wrap-around fluid conduit 1164, a first connection 166" to the associated chilled water return conduit 166, an output 1174, of the reheat coil 1170, and the associated hot water return conduit 286. The configuration is beneficial to effect return working warm water fluid return 284 via conduit 286 in proportion to the warm water supply 280 via conduit 282.

The balancing valve system 1182 of the regulator circuit 1180 of the moisture control system 1100 according to the example embodiment includes a first balancing valve 1188 disposed in-line between the input 166' of the wrap-around fluid conduit 1164 and the first connection 166" to the associated chilled water return conduit 166, and a blending regulator 1183 disposed at the connection between the associated hot water return conduit 286, the output 1174 of the reheat coil 1170, and the first connection 166" to the associated chilled water return conduit 166.

It is to be appreciated that the first balancing valve 1188 of the moisture control system 1100 is adjustable to control a flow volume of the cold working fluid 1150 entering the input 166' of the wrap-around fluid conduit 1164 as the first portion 1154 of the cold working fluid 1150.

It is further to be appreciated that the blending regulator 1183 of the moisture control system 1100 according to embodiment includes second and third balancing valves 1134, 1186. The second balancing valve 1134 is disposed between the associated hot water return conduit 286 and a second connection 166'" to the associated chilled water return conduit 166. The second balancing valve 1134 is preferably adjustable to control a flow volume of a blend of the warm and cold working fluids being returned to the associated hot water return 284. The third balancing valve 1186 is disposed between the first and second connections 166", 166'" to the associated chilled water return conduit 166. The third balancing valve 1186 is similarly preferably adjustable to control a flow volume of the blend of the warm and cold working fluids being returned to the associated cold water return 264.

As shown, the output 1174 of the reheat coil 1170 of the moisture control system 1100 according to embodiment is in fluid communication with the associated hot water return conduit 286 via the second balancing valve 1134, and is further in fluid communication with the associated chilled water return 164 via the third balancing valve 1186.

Yet still further, the regulator circuit 1180 of the moisture control system 1100 according to the example embodiment shown includes an automatic throttling valve 1198 disposed between the associated hot water source conduit 282 and the wrap-around fluid conduit 1164. The automatic throttling valve 1198 is responsive to a control signal from an associated control device to throttle a flow of the warm working fluid 1152 entering into the associated reheat coil 1170 via the wrap-around fluid conduit 1164.

With further reference to FIG. 11, as shown in particular, the wrap-around fluid conduit 1164 of the moisture control system 1100 of the example embodiment includes a waste conduit 1168 fluidically coupling the associated chilled water return conduit 166 at a waste connection 1168' with a portion of the wrap-around fluid conduit 1166 between the output 1144" of the precooling coil portion 1140" and the input 1172 of the associated reheat coil 1170. Also, the regulator circuit 1180 of the moisture control system 1100 of the example embodiment includes a second automatic throttling valve 1146 in operative fluid communication at the waste connection 1168', with the wrap-around fluid conduit 1166, and with the waste conduit 1168. The second automatic throttling valve 1146 of the example embodiment is operable responsive to a waste signal to divert a waste portion 1154' of the first portion 1154 of the working fluid 1150 from the portion of the wrap-around fluid conduit 1164 between the output 1144" of the precooling coil 1140 and the input 1172 of the associated reheat coil 1170 to the chilled water return conduit 166 via the waste conduit 1168.

With further reference to FIG. 11, as shown in particular, the regulator circuit 1180 of the moisture control system 1100 of the example embodiment includes a third balancing valve 1174 disposed in series with the second automatic throttling valve 1146 between the waste connection 1168' and the associated chilled water return conduit 166. Preferably, in the embodiment illustrated, the third balancing valve 1174 is adjustable to control a flow volume of the waste portion 1176 of the first portion 1154 of the working fluid 1150 diverted from the portion of the wrap-around fluid conduit 1164 between the output 1144" of the precooling coil portion 1140" and the input 1172 of the associated reheat coil 1170 to the chilled water return conduit 166 via the waste conduit 1068.

Figure 12A:
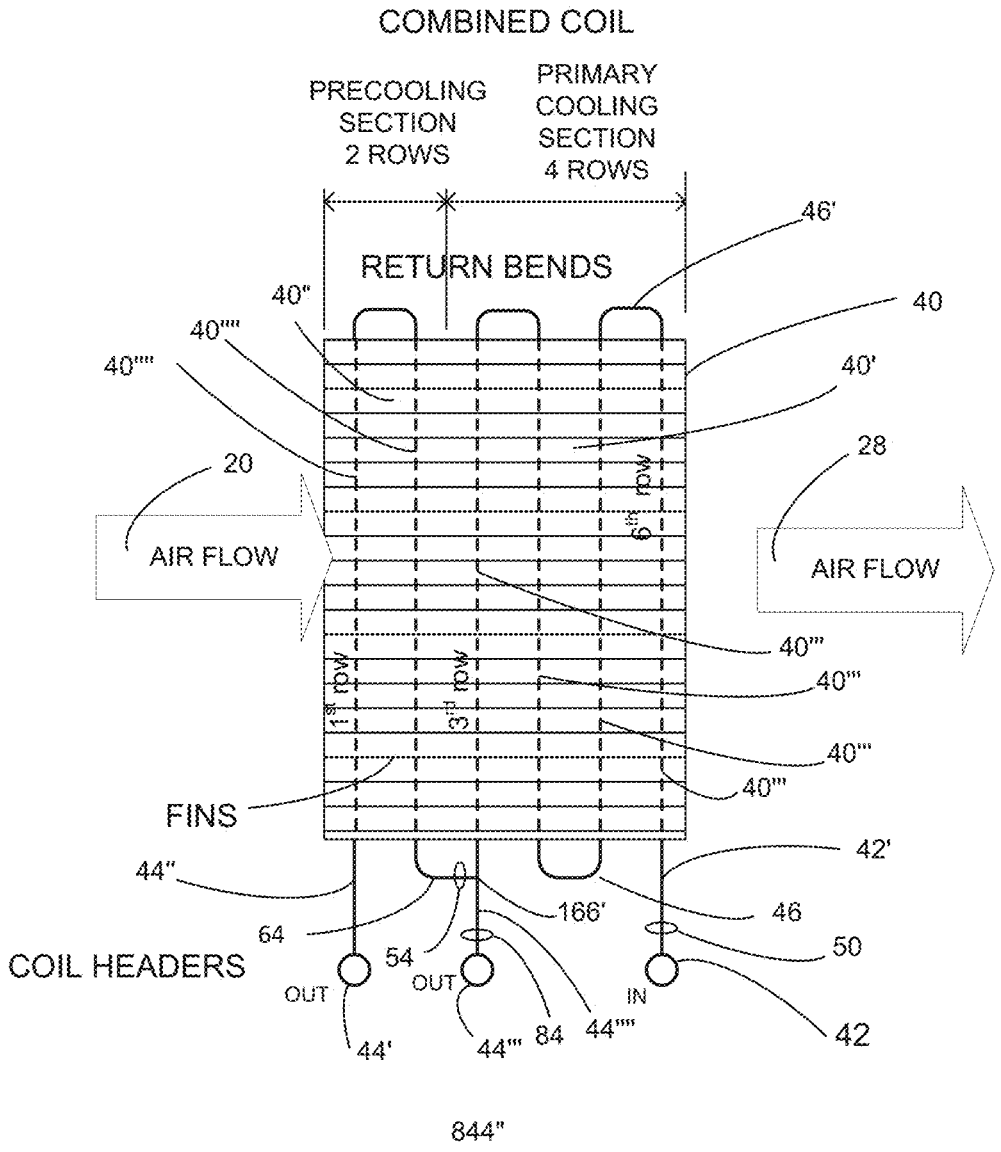
FIGS. 12A and 12B illustrate detailed views of a combined precooling coil and primary cooling coil integrated into a single composite coil.

FIG. 12A illustrates a detailed view of a combined precooling coil and primary cooling coil integrated into a single composite coil. With particular reference now to FIG. 12A, the precooling and primary cooling functions of the two coils are combined into a single Combined Coil 40 which includes the rows of tubes 40"" for the precooling section 40" and the rows of tubes 40'" for the primary Cooling section 40'. The fins for the single coil are continuous through the entire coil and are thermally connected to the tubes of the primary cooling section 40'" and the precooling section 40"" of the coil 40.

The combined coil 40 is further described in detail. The tubes of each row of the coil are stacked and are further illustrated in FIG. 12B. A header conduit 42 is positioned perpendicular to the last row of the coil 40 which is in this example row six. The header conduit has feed tubes 42' attached to enable the working fluid 50 to be transferred to specific tubes of the last row. The number of feed tubes and the positioning of the feed tubes is determined by the coil manufacture to optimize the heat transfer air flow 20 to the working fluid 50. The working fluid 50 divides proportionately between the number of feed tubes 42'. Each feed tube is connected to a tube in the stack of tubes in the last row. There are specially formed tubes called return bends 46, 46' at the end of the tubes to facilitate the working fluid 50 to flow to adjacent tubes in the same row or in the next row of tubes. The tubes and return bends are connected to provide continuous paths called circuits for the proportionately divided flow of working fluid 50 to travel unimpeded through the tubes 40'" and 40"" of the coil 40. At the intermediate row, in this example the third row, an outlet of each circuit is provided with a feed tube 44'" that connects the circuit to the intermediate outlet header conduit 44'. The feed tubes 44'" are provided with connections 166' that are continuation of the coil circuits and contain the inlets 42' to the precooling section 40". A first portion of the working fluid proportionately enters the tubes of the precooling section. The first portion of the working fluid travels through the tubes and return bends of the precooling section. At the first row of the coil the first portion of the working fluid leaves the coil through the feed tubes 44"" which are connected to the outlet header conduit 44".

Extracting a the first portion 54 of the working fluid 50 at the intermediate row will allow only a reduced amount of working fluid (first portion) to continue on through the remaining rows of tubes. The reduced flow will result in a greater temperature rise of the continuing first portion flow then what would be achieved had the entire working fluid flow continued through the remaining rows. The warmer water is more useful for reheat as there will be a greater temperature differential between the first portion of the working fluid and the air stream 30 leaving the reheat coil than could be achieved with the full flow of the working fluid.

Figure 12B:
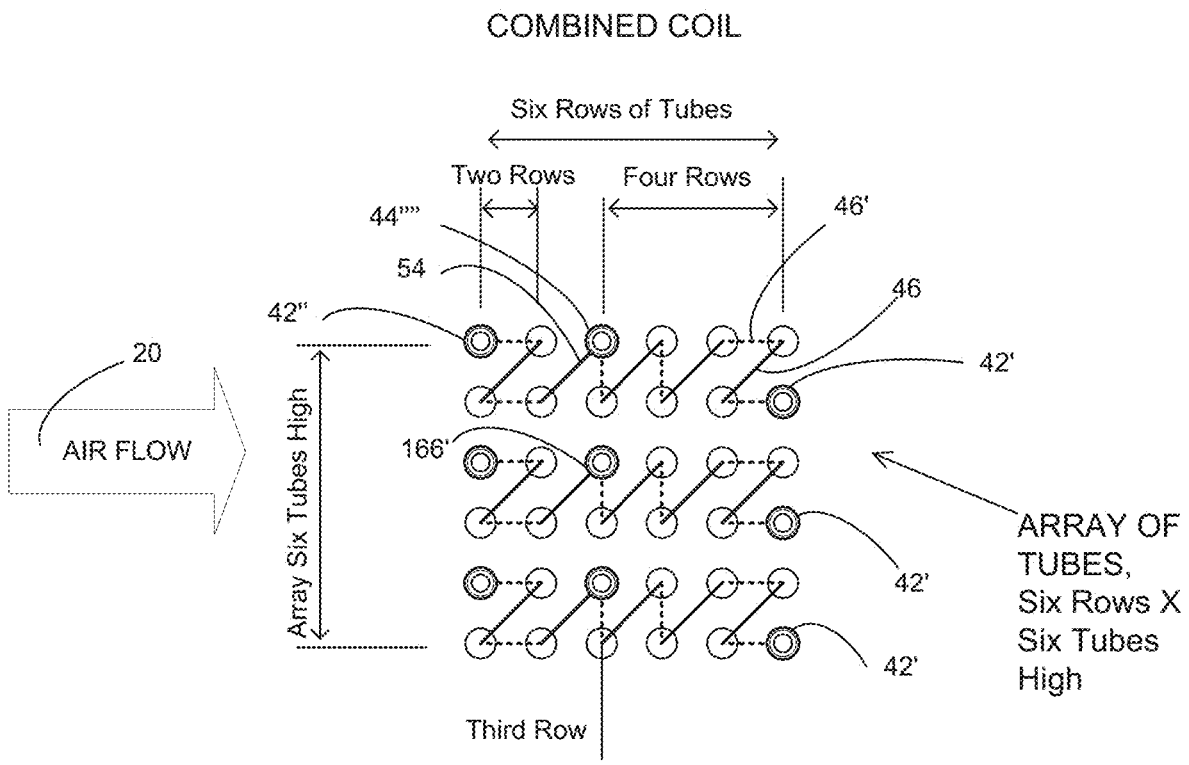

FIG. 12B illustrates a side view of the coil section. The tubes of the coil 40 are arranged in an array of rows of tubes by the number of tubes in each row. The tubes of the coil are perpendicular to the coil header pipes, 42, 44' and 44" which are shown in FIG. 12A. The inlet header conduit 42, not shown, is connected to the feed tubes 42'. In this example there are three circuits of tubes therefor there are three feed tubes 42'. The feed tubes fluidically connect to the tubes 40'"

of the primary cooling coil section of the cooling coil 40 shown on FIG. 12A. Return bends 46' on the far side of the coil and return bends 46 on the near side of the coil connect subsequent rows of tubes.

The intermediate outlet header conduit 44', not shown, is connected to the multiple feed tubes 44''' of the intermediate row. A portion of the working fluid 50 leaves the coil through header 44' and continues through conduit 166 not shown to the chilled water return 164 not shown.

The multiple feed tubes 44''' have multiple connections 166' which is the inlet to the wrap around system which starts at multiple tubes 64. There are multiple tubes 64, one for each circuit of coil 40. The outlet header conduit 44'', not shown, is connected to the multiple feed tubes 44'''', and collects the multiple flow circuits of the first portion of working fluid 50 and forms the continuation of the wrap around loop conduit.

Figure 13:
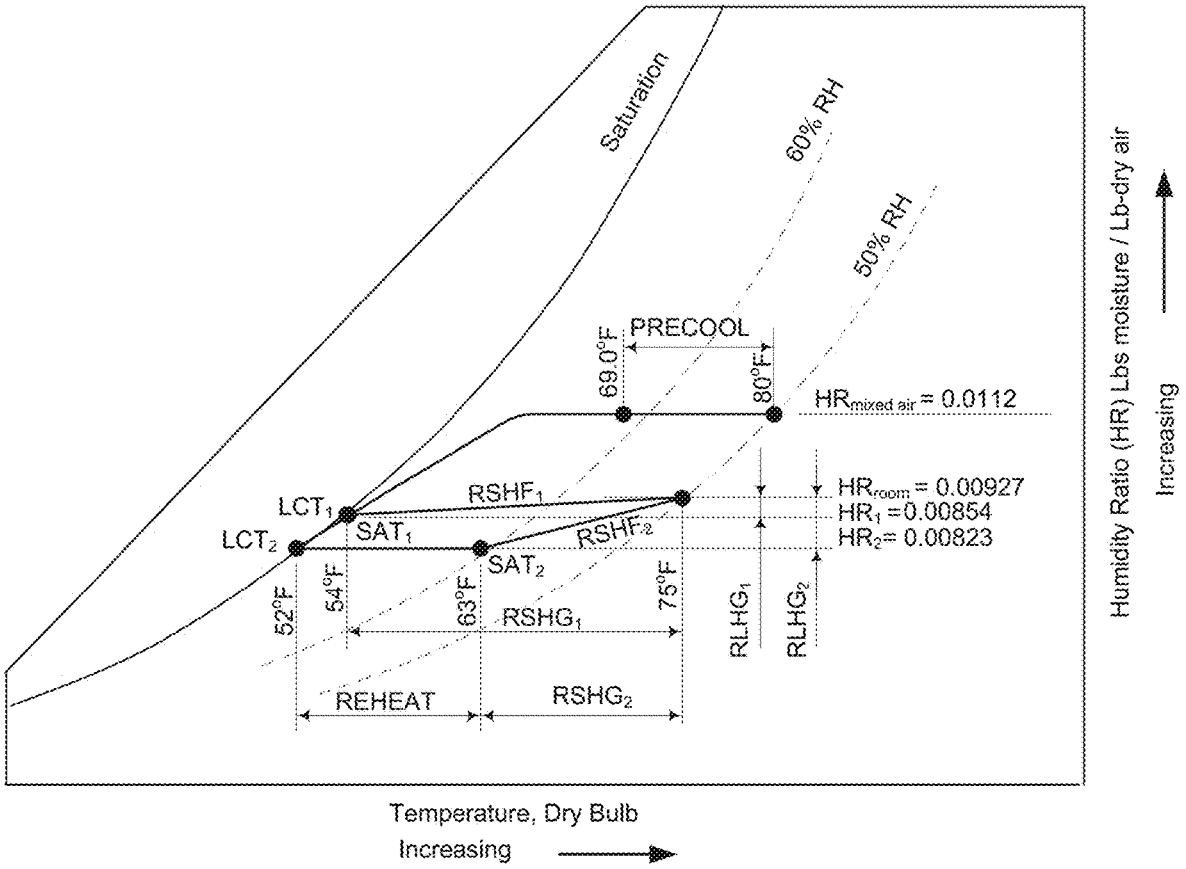
FIG. 13 illustrates a psychometric chart that is used in the description of the benefit of using reheat for humidity control.

FIG. 13 illustrates a psychometric chart that is used in the description of the benefit of using reheat for humidity control. With reference now to that FIGURE, some sample calculations are presented below.

Given that a space to be air conditioned to maintain a room temperature of 75° F. and 50% RH has a peak Room Sensible Heat Gain (RSHG1) of 230,700 btu/hr and peak Room Latent Heat Gain (RLHG1) of 35,700 btu/hr. A representative part load RSHG2 for the room is 92,300 btu/hr and part load RLHG2 is 35,700 but/hr. Note that the peak RLHG1 is equal to the part load RLHG2 for this example. Since latent heat gain in a room is primarily from the occupants of the room it is typical for the latent heat gain to be constant over a broad range of room sensible cooling requirements. For this example a mixed return air/outside air condition of 80° F. and 0.0112 lbs water/lb dry air Humidity Ratio (HR). For this example the heat gain from supply air and return air fans is ignored for simplification.

The air conditioning method selected for this example incorporates a Variable Air Volume (VAV) temperature control system for room air temperature control is selected to provide the air conditioning for an indoor room. A VAV system is one in which the supply air volume delivered to the room is modulated (varied) in response to changes in the room sensible cooling load using the room dry bulb temperature as the indication of changes in the room sensible cooling load. As the room dry bulb temperature increases (indicating an increase in the room sensible cooling load) the air volume is increased by action of a temperature control system and conversely as the room dry bulb temperature drops the control system reduces the air flow delivered to the room. An unintended consequence of reducing the supply air volume to satisfy reduction in the room sensible cooling load is that the potential for satisfying the room latent cooling load is also reduced in proportion to the amount of sensible cooling reduction. Since room latent cooling loads are relatively constant over a broad range of room sensible cooling loads there would be an increase in the room relative humidity when the air volume is decreased unless the supply air conditions are changed to compensate for the part load cooling load. The change required for the part load supply air temperature are indicated by plotting the room sensible heat factor for the full and part load condition on a psychrometric chart.

For this example the room temperature is to be maintained at 75° F. dry bulb (DB) and the room humidity is to be maintained at 50% relative humidity (RH). The humidity ratio for 75° F. DB at 50% RH is 0.00927 lb. moisture/lb of dry air. The peak room sensible cooling load is 230,700 btu/hr and a representative part load room sensible cooling load is 92,300 btu/hr. The room latent cooling load is a constant 35,700 btu/hr. The room sensible heat factor (RSHF) for peak and part load conditions is calculated as follows:

$$RSHF=RSHG/(RSHG+RLHG)$$

$$RSHF_1=230{,}300/(230{,}300+35{,}700)=0.87 \quad \text{Peak Load:}$$

$$RSHF_2=92{,}300/(92{,}300+35{,}700)=0.72 \quad \text{Part Load:}$$

Plotting $RSHF_1$ and $RSHF_2$ on a psychrometric chart, as shown on FIG. 4 indicates the range of possible supply air temperatures that can be used to calculate the required supply air volume to satisfy the room cooling load both at peak cooling conditions and the representative part load condition.

The supply air temperature for peak room cooling is selected to be 54 degrees ($SAT_1$). The peak supply air volume ($CFM_1$) can then be calculated as follows.

$$CFM_1=230{,}300/(1.1\times(75-54))=10{,}000$$

Selecting 7000 cfm as the minimum supply air volume ($CFM_2$) the supply air temperature for the minimum space cooling load can be calculated as follows.

$$SAT_2=75-(92{,}700/(1.1\times7000))=63°\text{ F. DB}$$

The room latent cooling that will be provided by the supply air for both peak load room latent heat gain ($RLHG_1$) and part load room latent heat gain ($RLHG_2$) conditions can be verified by calculation. The humidity ratio for the room condition ($HR_{room}$=0.00927 lb. moisture/lb. dry air) and the supply air condition for peak load ($HR_{room}$=0.00854) and part load ($HR_2$=0.00823) can be obtained by inspection of the psychrometric chart. The latent cooling available can be calculated as follows.

$$RLHG = 4840\times CFM\times(HR_{room}-HR_{1or2})\ \text{Peak Load;}$$

$$RLHG_1 = 4840\times 10{,}000\ \text{cfm}\times(0.00927-0.00854) = 35{,}300\ \text{btu/hr}$$

$$\text{Part Load; } RLHG_2 = 4840\times 7{,}000\ \text{cfm}\times(0.00927-0.00823)$$

$$=35{,}300\ \text{btu/hr}$$

Reheat is not required for the Peak cooling load because the selection of 54° F. DB supply air temperature and 0.00854 supply air humidity ratio ensures the room conditions will be maintained when 10,000 cfm is delivered to the room at this condition. Heat generated by the supply air fan provides some reheat (SAT1) which is indicated on the psychrometric chart, FIG. 4. Reheat is required for the part load condition because the part load sensible heat factor line, $RSHF_2$, does not intersect with the saturation line, refer to FIG. 4. For part load cooling Air leaves the cooling coil at LCT2 and is reheated by the reheat coil and is further reheated to SAT2 by heat generated by the supply air fan. The reheat coil will be selected to provide the reheat for part load operation which is calculated as follows:

$$\text{Reheat}=7{,}000\ \text{cfm}\times1.1\times(61-52)=69{,}300\ \text{btu/hr}$$

The water temperature and flow rate entering the reheat coil needs to be sufficient to provide the desired supply air temperature leaving the reheat heat coil. The water temperature and flow rate also needs to be consistent with what will be an available condition leaving the precooling section of the cooling coil. For this example 68.4 degrees F. and 13.5 gpm was selected as the entering reheat coil condition. The temperature drop in the water flow for this example can be calculated as follows.

$$\begin{aligned}\text{Leaving Reheat Coil Water Temperature} &= \text{Entering Coil Temperature} - \\ &\quad \text{Coil Heat Transfer/} \\ &\quad \text{conversion factor/} \\ &\quad \text{coil flow rate} \\ &= 68.4 - 69{,}300 \text{ btu/hr}/500/13.5 \\ &= 58.1 \text{ degrees F.}\end{aligned}$$

The cooling coil is then selected to provide both peak cooling and part load cooling. In addition, the cooling coil is selected so as to provide the heat source for the reheat requirement. This requires that the leaving precooling section of the cooling coil needs to be a minimum of 13.5 gpm at a minimum of 68.4 degrees F. as indicated for the reheat coil selection. The peak cooling required by the cooling coil is the sum of the sensible cooling and the latent cooling as needed to cool the air from the entering cooling coil conditions to the leaving cooling coil conditions at 10,000 cfm supply air volume. The entering cooling coil air condition is 80° F. DB Temperature at Humidity Ratio 0.0112 lb water/lb dry air which is a typical condition used to illustrate mixed return air and outside air conditions. The peak cooling required of the cooling coil is calculated as follows.

$$\begin{aligned}\text{Peak Cooling} = RSHG_1 + RSHG_1 &= 10{,}000\ CFM_1 \times (1.1 \times (80 - 53) + \\ &\quad 4840 \times (0.0112 - 0.00854)) \\ &= 10{,}000\ CFM_1 \times (29.7 + 12.9) \\ &= 426{,}000 \text{ btu/hr}\end{aligned}$$

The temperature of the chilled water entering the combined coil is 45 degrees. The coil is selected for a 16 degree chilled water temperature rise. A seven row coil is selected and the required chilled water flow rate is calculated as follows:

$$GPM_1 = 426{,}000/(500 \times 16) = 53.3 \text{ GPM}$$

The selected part load cooling to be provided by the cooling coil can be calculated as follows.

$$\begin{aligned}\text{Part Load Cooling} = RSHG_2 + RLHG_2 &= 7{,}000 \times CFM_2 \times (1.1 \times (80 - 52) + \\ &\quad 4840 \times (0.0112 - 0.00823)) \\ &= 7{,}000 \times CFM_2 \times (30.8 + 14.4) \\ &= 316{,}400 \text{ btu/hr}\end{aligned}$$

The cooling coil selected for peak cooling is then evaluated for the part load cooling duty to determine where the coil is to be divided for the precooling and primary cooling sections. The evaluation using coil selection procedures yields the following performance; 1) the precooling section will consist of the first 3 rows from the air entering end of the coil and will provide 93,500 btu/hr of cooling as it cools the air from the entering coil condition of 80/0.0112 to an intermediate condition of 67.9 DB/0.0112 using 13.5 gpm of water at an entering water temperature of 54.6 degrees and a leaving water temperature of 68.4 degrees, and 2) the primary section will consist of the final 4 rows of the coil and will provide 222,900 btu/hr of cooling as it cools the air from the intermediate condition to the leaving coil condition using 46 gpm of chilled water at an entering temperature of 45 degrees and a leaving water temperature of 54.6 degrees.

The chilled water extracted from the coil at the intermediate position joins the water leaving the reheat coil. The mixed extracted water and return water are mixed and the mixed water is returned to the chiller plant. The mixed water temperature is calculated using a mixing formula $$\begin{aligned}\text{Mixed Temperature} &= (T1 \times Flow1 + T2 \times Flow2)/(Flow1 + Flow2) \\ &= (54.6 \times 32.5 + 58.2 \times 13.5)/(32.5 + 13.5) \\ &= 55.7 \text{ degrees F.}\end{aligned}$$

The invention claimed is:

1. A moisture control system for use with an associated four-pipe air conditioning system, the associated four-pipe air conditioning system including an associated cooling coil where a cold working fluid flowing through the associated cooling coil absorbs thermal energy from a return air flow to produce a cooled supply air flow, an associated reheat coil where a warm working fluid flowing through the reheat coil adds thermal energy to the cooled supply air flow to produce a reheated supply air flow, an associated chilled water source conduit delivering the cold working fluid from an associated chilled water source to the associated cooling coil, an associated chilled water return conduit returning the cold working fluid from the associated cooling coil to an associated chilled water return, an associated hot water source conduit delivering the warm working fluid from an associated hot water source to the reheat coil, an associated hot water return conduit returning the warm working fluid from the reheat coil to an associated hot water return, the moisture control system comprising:

a precooling coil in the return air flow, the precooling coil receiving a first portion of the cold working fluid and exchanging thermal energy between the return air flow and the first portion of the cold working fluid flowing through the precooling coil;

a wrap-around fluid conduit in operative fluid communication with the associated chilled water return conduit, the precooling coil, the associated reheat coil, and the associated hot water return conduit, the wrap-around fluid conduit being configured to containedly direct fluid through a series arrangement of an input of the wrap-around fluid conduit, the precooling coil, and the associated reheat coil, wherein the wrap-around fluid conduit directs the first portion of the working fluid through a series arrangement of the input of the wrap-around fluid conduit and the precooling coil and a second portion of the working fluid through a series arrangement of the reheat coil and the associated chilled water return conduit; and a flow regulator system operatively coupled with the input of the wrap-around fluid conduit and with the associated chilled water return conduit, the flow regulator system generating the first portion of the cold working fluid for communication to the input of the wrap-around fluid conduit by metering the cold working fluid returned to the associated chilled water return conduit.

2. The moisture control system according to claim 1, wherein:

the precooling coil comprises an input in operative fluid communication via the wrap-around fluid conduit with the associated chilled water return conduit;

the wrap-around fluid conduit containedly directs all of the first portion of the cold working fluid from an output of the precooling coil to an input of the associated reheat coil; and the wrap-around fluid conduit comprises a bridge conduit portion fluidically coupling the associated chilled water return conduit with the associated hot water source conduit.

3. The moisture control system according to claim 1, wherein the flow regulator system comprises:

a plurality of flow regulators disposed at a fluid connection between:

the input of the wrap-around fluid conduit;

a first fluid connection to the associated chilled water return conduit;

an output of the reheat coil; and the associated hot water return conduit.

4. The moisture control system according to claim 3, wherein the plurality of flow regulators of the flow regulator system comprises:

a first flow regulator comprising a first balancing valve disposed in-line between the input of the wrap-around fluid conduit and the first fluid connection to the associated chilled water return conduit; and a second flow regulator disposed at a connection between the associated hot water return conduit, the output of the reheat coil, and the first fluid connection to the associated chilled water return conduit.

5. The moisture control system according to claim 4, wherein:

the first balancing valve is adjustable to control a flow volume of the cold working fluid entering the input of the wrap-around fluid conduit as the first portion of the cold working fluid.

6. The moisture control system according to claim 5, wherein:

the plurality of flow regulators comprises a third flow regulator comprising:

a second balancing valve disposed between the associated hot water return conduit and a second connection to the associated chilled water return conduit, the second balancing valve being adjustable to control a flow volume of a blend of the warm and cold working fluids being returned to the associated hot water return; and the second flow regulator comprises:

a third balancing valve disposed between the first and second connections to the associated chilled water return conduit, the third balancing valve being adjustable to control a flow volume of the blend of the warm and cold working fluids being returned to the associated cold water return.

7. The moisture control system according to claim 6, wherein the output of the reheat coil is in fluid communication with the associated hot water return conduit via the second balancing valve; and the output of the reheat coil is in fluid communication with the associated chilled water return via the third balancing valve.

8. The moisture control system according to claim 7, wherein the flow regulator system comprises:

an automatic throttling valve disposed between the associated hot water source conduit and the wrap-around fluid conduit, the automatic throttling valve being operative to throttle a flow of the warm working fluid entering into the associated reheat coil via the wrap-around fluid conduit.

9. The moisture control system according to claim 8, wherein the flow regulator system comprises:

a second automatic throttling valve disposed in series with the first balancing valve, the second automatic throttling valve being operative to throttle a flow of the cold working fluid being returned to the associated cold water return.

* * * * *